US008147254B2

(12) United States Patent
Shuey et al.

(10) Patent No.: US 8,147,254 B2
(45) Date of Patent: Apr. 3, 2012

(54) ELECTRICAL CONNECTOR MATING GUIDE

(75) Inventors: Joseph B. Shuey, Camp Hill, PA (US); Mark R. Gray, York, PA (US); Lewis Robin Johnson, Dover, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/197,434

(22) Filed: Aug. 25, 2008

(65) Prior Publication Data

US 2009/0130912 A1 May 21, 2009

Related U.S. Application Data

(60) Provisional application No. 60/988,328, filed on Nov. 15, 2007.

(51) Int. Cl.
*H01R 12/00* (2006.01)

(52) U.S. Cl. ..... 439/74

(58) Field of Classification Search ..... 439/74, 439/108, 65, 101, 83

See application file for complete search history.

(56) References Cited

U.S. PATENT DOCUMENTS

| | | | |
|---|---|---|---|
| 741,052 | A | 10/1903 | Mahon |
| 3,072,340 | A | 1/1963 | Dean |
| 3,157,448 | A | 11/1964 | Crimmins et al. |
| 3,461,258 | A | 8/1969 | Shlesinger, Jr. |
| 3,482,201 | A | 12/1969 | Schneck |
| 3,663,925 | A | 5/1972 | Proctor |
| 3,827,007 | A | 7/1974 | Fairbairn et al. |
| 3,867,008 | A | 2/1975 | Gartland, Jr. |
| 4,045,105 | A | 8/1977 | Lee et al. |
| 4,148,543 | A | 4/1979 | Shores |
| 4,232,924 | A | 11/1980 | Kline et al. |
| 4,482,937 | A | 11/1984 | Berg et al. |
| 4,552,425 | A | 11/1985 | Billman |
| 4,582,386 | A | 4/1986 | Martens |
| 4,664,456 | A | 5/1987 | Blair et al. |
| 4,664,458 | A | 5/1987 | Worth |
| 4,737,118 | A | 4/1988 | Lockard |
| 4,820,182 | A | 4/1989 | Harwath |

(Continued)

FOREIGN PATENT DOCUMENTS

| | | |
|---|---|---|
| GB | 2 299 465 | 10/1996 |

(Continued)

OTHER PUBLICATIONS

U.S. Appl. No. 10/940,329, filed Sep. 14, 2004, Johnescu, D.

(Continued)

*Primary Examiner* — Jean F Duverne
(74) *Attorney, Agent, or Firm* — Woodcock Washburn LLP

(57) ABSTRACT

An electrical connector with at least two connector portions. A first connector portion and a second connector portion may each be mountable on a respective surface, such as a printed circuit board. The first and second connector portions may each include a housing. The housing of the first connector portion may include a bore and an adjacent pin. The housing of the second connector portion may also include a bore and an adjacent pin. The pin of the first connector portion may be received in the bore of the second connector portion, and the pin of the second connector portion may be received in the bore of the first connector portion, when the two connector portions are mated to one another. In one embodiment, the first and second connector portions may be substantially identical to one another.

12 Claims, 16 Drawing Sheets

U.S. PATENT DOCUMENTS 5,030,121 A 7/1991 Noorily
5,035,639 A 7/1991 Kilpatrick
5,055,054 A 10/1991 Doutrich
5,098,311 A 3/1992 Roath et al.
5,127,839 A 7/1992 Korsunsky et al.
5,161,985 A 11/1992 Ramsey
5,167,528 A 12/1992 Nishiyama et al.
5,181,855 A * 1/1993 Mosquera et al. ..... 439/74
5,334,029 A 8/1994 Akkapeddi et al.
5,382,168 A 1/1995 Azuma et al.
5,387,139 A 2/1995 McKee et al.
5,395,250 A 3/1995 Englert et al.
5,498,167 A 3/1996 Seto et al.
5,520,545 A 5/1996 Sipe
5,527,189 A 6/1996 Middlehurst et al.
5,562,442 A 10/1996 Wilhelm
5,573,409 A 11/1996 Shiley et al.
5,618,191 A * 4/1997 Chikano et al. ..... 439/108
5,664,968 A 9/1997 Mickievicz
5,697,799 A 12/1997 Consoli et al.
5,730,606 A 3/1998 Sinclair
5,782,656 A 7/1998 Zell et al.
5,795,191 A 8/1998 Preputnick et al.
5,871,362 A 2/1999 Campbell et al.
5,893,761 A 4/1999 Longueville
5,902,136 A 5/1999 Lemke et al.
5,904,581 A * 5/1999 Pope et al. ..... 439/74
5,904,594 A 5/1999 Longueville et al.
RE36,217 E 6/1999 Peterson
5,971,800 A 10/1999 Azuma et al.
5,984,690 A 11/1999 Riechelmann et al.
5,992,953 A 11/1999 Rabinowitz
6,022,227 A 2/2000 Huang
6,024,584 A 2/2000 Lemke et al.
6,074,230 A 6/2000 Comerci et al.
6,079,991 A 6/2000 Lemke et al.
6,097,609 A 8/2000 Kabadi
6,129,592 A 10/2000 Mickievicz
6,146,208 A 11/2000 Pennell
6,152,747 A 11/2000 McNamara
6,154,742 A 11/2000 Herriot
6,164,983 A 12/2000 Lemke et al.
6,183,301 B1 2/2001 Paagman
6,193,537 B1 2/2001 Harper et al.
6,193,557 B1 2/2001 Luvini et al.
6,241,535 B1 6/2001 Lemke et al.
6,379,170 B1 4/2002 Czeschka et al.
6,390,826 B1 5/2002 Affolter et al.
6,409,543 B1 6/2002 Astbury et al.
6,443,750 B1 9/2002 Lemke et al.
6,475,010 B1 11/2002 Yu
6,494,734 B1 12/2002 Shuey
6,517,360 B1 2/2003 Cohen
6,537,087 B2 3/2003 McNamara et al.
6,540,529 B1 4/2003 Yu
6,641,410 B2 11/2003 Marvin et al.
6,699,048 B2 3/2004 Johnson et al.
6,702,590 B2 * 3/2004 Zaderej et al. ..... 439/74
6,712,626 B2 3/2004 Harper, Jr. et al.
6,835,072 B2 12/2004 Simons et al.
6,851,954 B2 2/2005 Ashman
6,860,741 B2 3/2005 Ashman et al.
6,869,292 B2 3/2005 Johnescu et al.
6,893,300 B2 5/2005 Zhou et al.
6,902,411 B2 6/2005 Kubo
6,918,776 B2 7/2005 Spink, Jr.
6,939,173 B1 9/2005 Elco et al.
6,951,466 B2 10/2005 Sandoval et al.
7,018,239 B2 * 3/2006 Zaderej et al. ..... 439/607.36
7,153,170 B1 12/2006 Fabian
7,182,608 B2 2/2007 Soh et al.
7,214,104 B2 5/2007 Minich et al.
7,220,141 B2 5/2007 Daily et al.
7,229,318 B2 6/2007 Winings
7,309,239 B2 12/2007 Shuey
7,407,387 B2 8/2008 Johnescu
7,452,249 B2 11/2008 Daily et al.
7,553,182 B2 6/2009 Buck
7,635,278 B2 12/2009 Shuey
2002/0127903 A1 9/2002 Billman et al.
2004/0157477 A1 8/2004 Johnson et al.
2005/0079763 A1 4/2005 Lemke et al.
2005/0101188 A1 5/2005 Benham et al.
2005/0277315 A1 12/2005 Mongold et al.
2006/0051987 A1 3/2006 Goodman et al.
2006/0148283 A1 7/2006 Minich et al.
2006/0172570 A1 8/2006 Minich et al.
2007/0004287 A1 1/2007 Marshall

FOREIGN PATENT DOCUMENTS

GB 2 312 566 10/1997
GB 2 345 807 7/2000
JP 56-51269 A 5/1981
JP 1276575 11/1989
JP 2177277 7/1990
JP 2297509 12/1990
JP 51-43434 A 6/1993
JP 2003317861 11/2003
WO WO 00/31832 6/2000
WO WO 2007/076901 7/2007

OTHER PUBLICATIONS

U.S. Appl. No. 10/779,172, filed Feb. 11, 2004, Johnescu, D.
U.S. Appl. No. 10/779,172, filed Feb. 11, 2004, Johnescu.
U.S. Appl. No. 10/940,329, filed Sep. 14, 2004, Johnescu.
In the United States Patent and Trademark Office, in Re. U.S. Appl. No. 12/616,807, Non-final office action dated Apr. 29, 2010.
In the United States Patent and Trademark Office, in Re. U.S. Appl. No. 12/616,807, Response to Non-final office action dated Sep. 29, 2010.
MicroStac, 0,8 mm Mezzanine Steckverbindersystem, www.emi.com, Katalog, D 074,520, Feb. 2008, 24 pages.
U.S. Appl. No. 12/616,807: Non-Final Rejection, dated Apr. 8, 2011, 5 pages.
U.S. Appl. No. 12/616,807: Response to Official Action dated Dec. 29, 2010, filed Mar. 25, 2011, 9 pages.
U.S. Appl. No. 12/616,807: Response to Official Action dated Mar. 4, 2010, filed Apr. 5, 2010, 6 pages.
U.S. Appl. No. 12/616,807: Restriction Requirement, dated Mar. 4, 2010, 5 pages.
U.S. Appl. No. 12/616,807; Final Rejection, dated Dec. 29, 2010, 7 pages.
U.S. Appl. No. 12/616,807: Response to Official Action dated Apr. 8, 2011, filed Jul. 8, 2011, 6 pages.

* cited by examiner

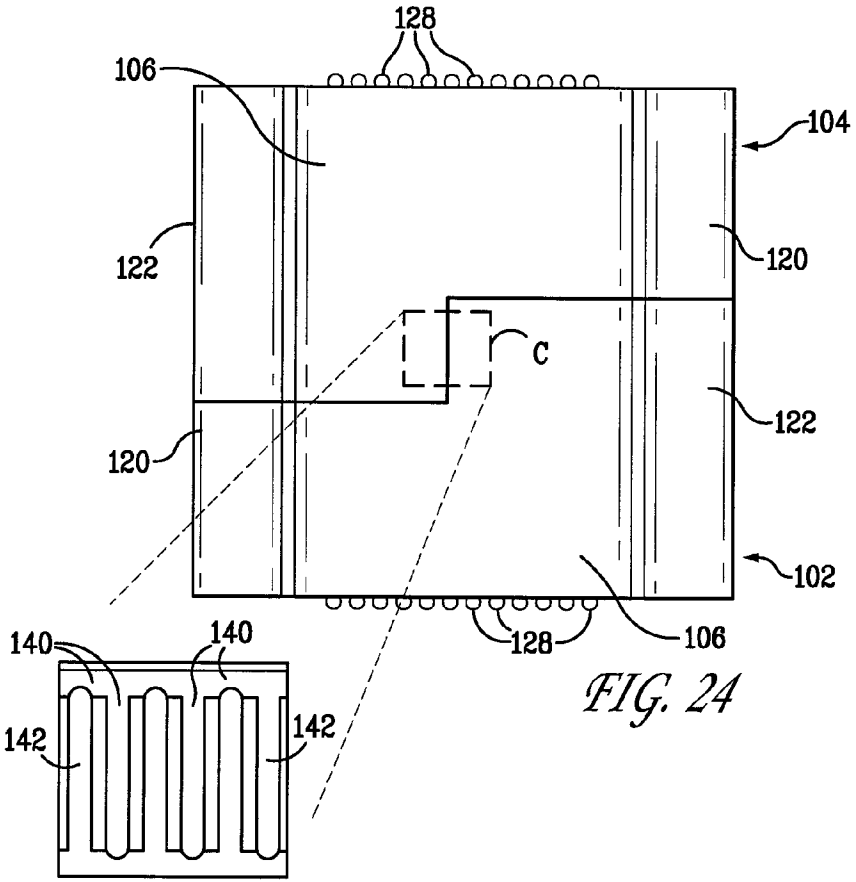
FIG. 24
FIG. 25
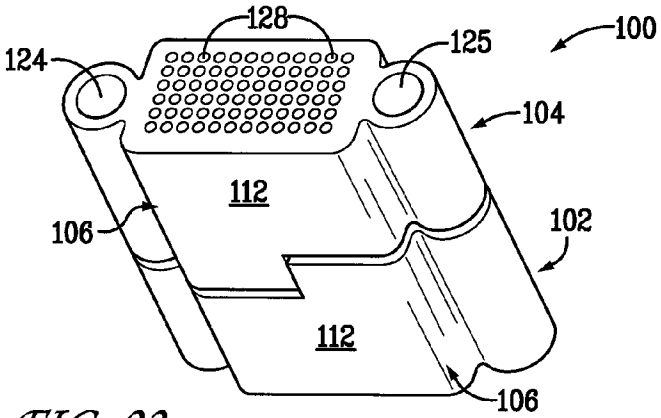
FIG. 22
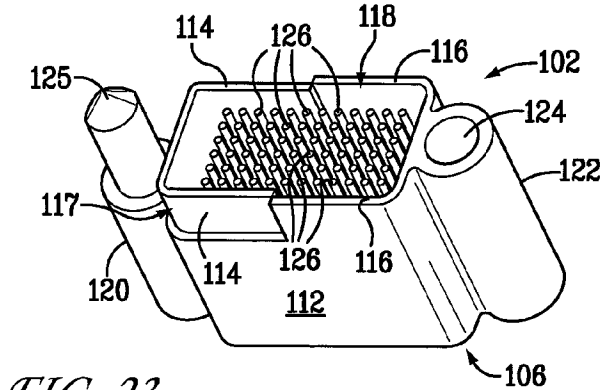
FIG. 23

200
204
202
206
208
206

202
212
206
218
208
216
214
217
212

200
228
204
202
228

236
240
242
236
236
240
242
236

234
242
240
236
238
226

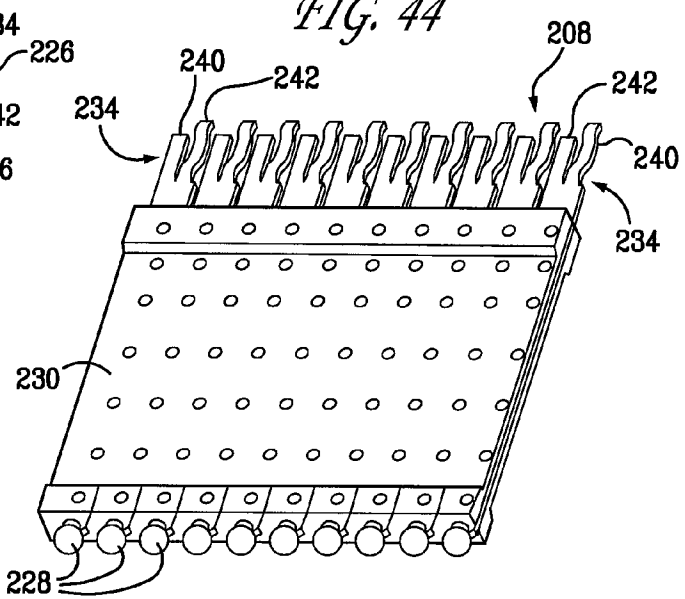
FIG. 44
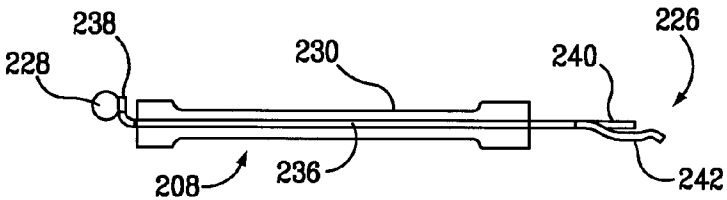
FIG. 45
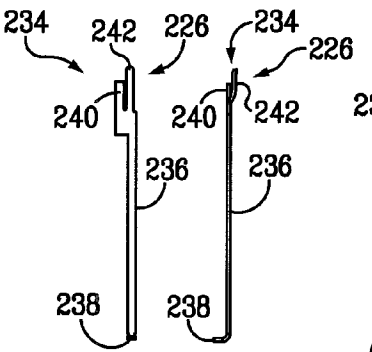
FIG. 43
FIG. 42
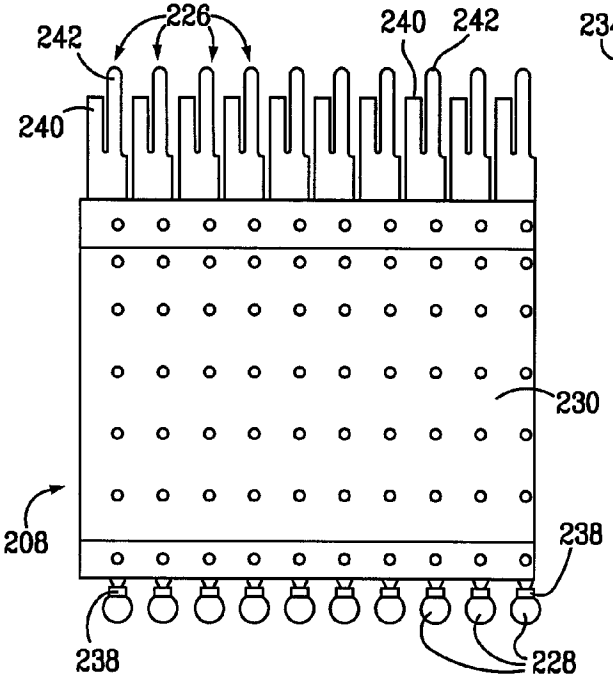
FIG. 39
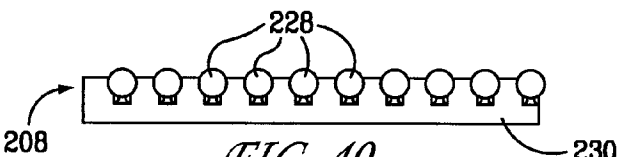
FIG. 40

ELECTRICAL CONNECTOR MATING GUIDE

CROSS REFERENCE TO RELATED APPLICATIONS

This application claims benefit under 35 U.S.C. §119(e) of provisional U.S. Patent Application No. 60/988,328, filed Nov. 15, 2007 and entitled "MEZZANINE-TYPE ELECTRICAL CONNECTORS," the disclosure of which is incorporated herein by reference in its entirety.

This application is related by subject matter to U.S. patent application Ser. No. 11/847,666, filed Aug. 30, 2007 and entitled "MEZZANINE-TYPE ELECTRICAL CONNECTORS," and Ser. No. 11/450,606, filed Jun. 9, 2006 and entitled "ELECTRICAL CONNECTORS WITH ALIGNMENT GUIDES."

BACKGROUND

An electrical connector may include a housing, one or more electrical conductors, and one or more fusible elements, such as solder balls, mounted on the electrical conductors. The solder balls are typically subjected to a reflow process that melts the solder. The molten solder, upon cooling, forms electrical and mechanical connections between the electrical conductors and a mounting surface or substrate, such as a printed circuit board (PCB).

The electrical connector may include two portions, a plug portion and a receptacle portion. The plug portion may be mounted on one substrate, and the receptacle portion may be mounted on another substrate. Upon mating the plug and receptacle portions to one another, an electrical connection may be established between the two substrates.

The plug and receptacle portions of the electrical connector often include different components. As such, the plug and receptacle portions are generally not identical to one another. For example, the electrical contacts of the plug portion may each have a plug mating interface, such as a blade-shaped mating end. The electrical contacts of the receptacle portion may each have a receptacle mating interface, such as two or more tines, that are configured to receive the blade-shaped mating end. Having connector components specific to each portion of the electrical connector generally increases the number and types of components needed to construct the electrical connector, resulting in increased manufacturing, tooling, and/or inventory-related costs.

To prevent the electrical contacts in the plug and receptacle portions of the electrical connector from becoming damaged during the mating process, the plug and receptacle portions may each include a guide portion configured to properly align the electrical contacts as the plug and receptacle portions are mated. Moreover, the guide portion of each of the plug and receptacle portions may help to retain the plug and receptacle portions in mated condition. Like the electrical contacts, the guide portion in the plug portion generally differs from the guide portion in the receptacle portion, further increasing manufacturing, tooling, and/or inventory-related costs.

SUMMARY

The disclosed embodiments include an electrical connector having at least two connector portions. The first connector portion may be mountable on one surface, such as a printed circuit board, and the second connector portion may be mountable on another surface, such as another printed circuit board. The first and second connector portions may each include a housing. The housing of the first connector portion may include a bore and an adjacent pin. The housing of the second connector portion may also include a bore and an adjacent pin. The pin of the first connector portion may be received in the bore of the second connector portion, and the pin of the second connector portion may be received in the bore of the first connector portion, when the two connector portions are mated to one another. In one embodiment, the first and second connector portions may be substantially identical to one another.

The disclosed embodiments also include an electrical connector with a connector housing and an electrical conductor extending at least partially into the connector housing. The connector housing may include two or more pins and two or more bores. Each respective pin may be adjacent to a respective bore in a direction.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings.

FIG. 22 is a top perspective view of another alternative embodiment of the electrical connector shown in FIG. 1, depicting first and second halves of the connector in a partially mated condition.

FIG. 23 is a top perspective view of the first half of the connector shown in FIG. 22.

FIG. 24 is a side view of the connector shown in FIGS. 22 and 23, depicting the first and second halves of the connector in a fully mated condition.

FIG. 25 is a magnified view of the area designated "C" in FIG. 24, with housings of the first and second halves of the connector made transparent to reveal mated electrical conductors within the housings.

FIG. 39 is a side view of an insert molded leadframe assembly of the connector shown in FIGS. 32-38.

FIG. 40 is a bottom view of the insert molded leadframe assembly shown in FIG. 39.

FIG. 42 is a side view of the electrical conductor shown in FIG. 41.

FIG. 43 is a side view of the electrical conductor shown in FIGS. 41 and 43, from a perspective rotated approximately ninety degrees from the perspective of FIG. 42.

FIG. 44 is a bottom view of the insert molded leadframe assembly shown in FIGS. 39 and 40.

FIG. 45 is a side view of the insert molded leadframe assembly shown in FIGS. 39, 40, and 44, from a perspective rotated approximately ninety degrees from the perspective of FIG. 39.

DETAILED DESCRIPTION OF ILLUSTRATIVE EMBODIMENTS

Figure 1:
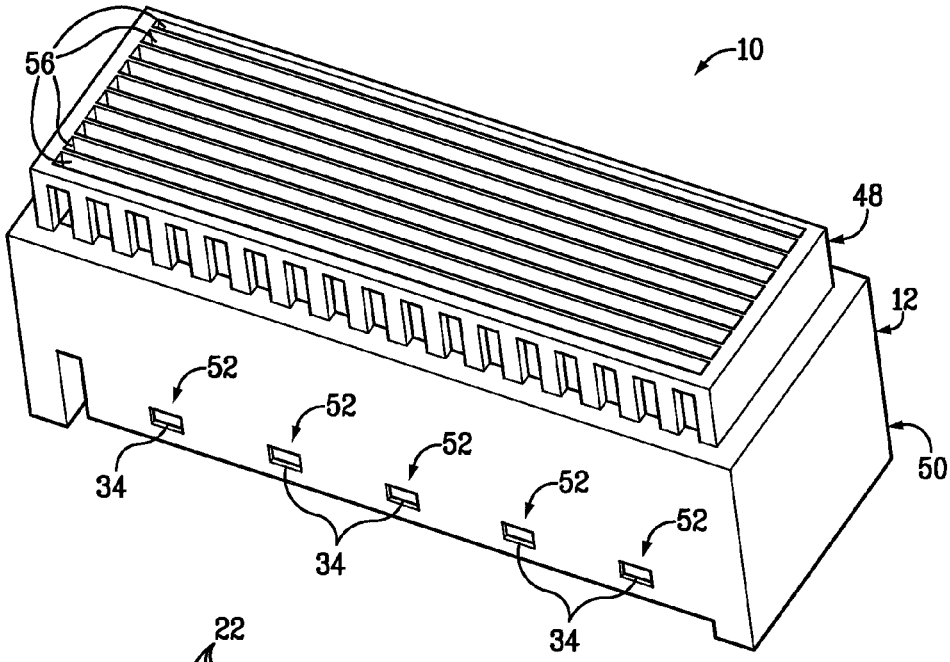
FIG. 1 is a top perspective view of an electrical connector.
Figure 2:
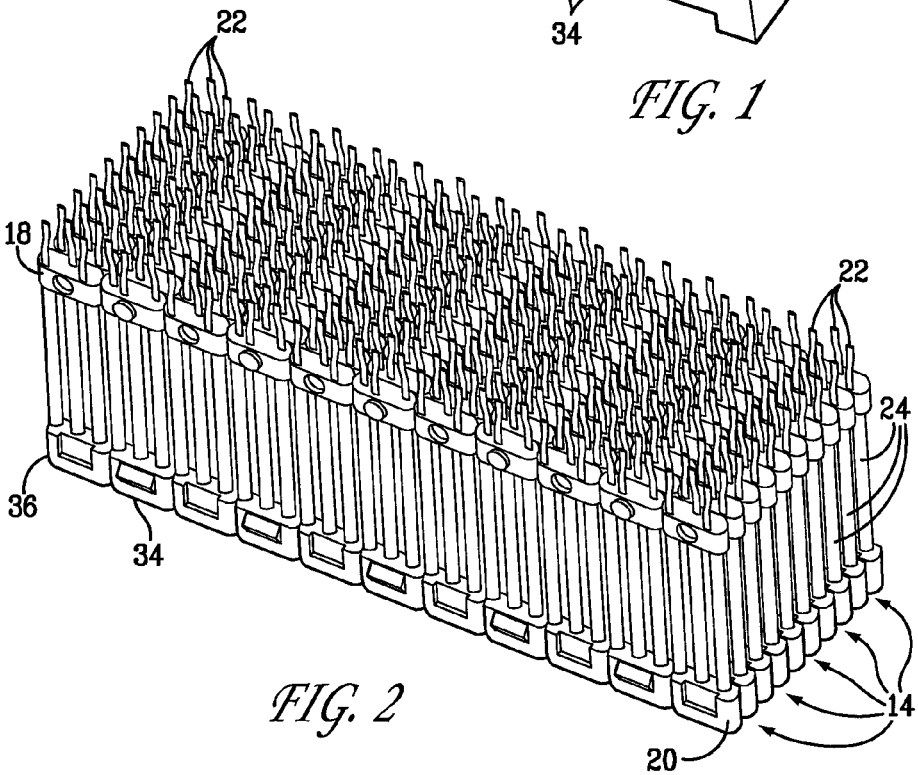
FIG. 2 is a top perspective view of insert molded leadframe assemblies of the connector shown in FIG. 1.

FIGS. 1 through 15 depict an electrical connector 10. The connector 10 can form part of a mezzanine connector system that electrically connects a first and a second electrical device such as a first and a second circuit substrate. The connector 10 comprises an electrically-insulative housing 12, and a plurality of insert molded leadframe assemblies (IMLAs) 14 contained within the housing 12. The connector 10 is depicted with ten of the IMLAs 14 for exemplary purposes only; alternative embodiments can include more, or less than ten of the IMLAs 14.

Each IMLA 14 includes a plurality of electrical conductors 16, and a plurality of fusible elements such as solder balls 17. Each IMLA 14 also includes an electrically-insulative upper frame 18, and an electrically-insulative lower frame 20. The IMLAs 14 are depicted with thirty-three of the electrical conductors 16 and thirty-three of the solder balls 17 for exemplary purposes only; the IMLAs 108 of alternative embodiments can include more, or less than thirty-three of the electrical conductors 16 and solder balls 17.

Each electrical conductor 16 includes a contact beam 22, a lead portion 24 that adjoins the contact beam 22, and a post 26 that adjoins an end of the lead portion 24 distal the contact beam 22. Adjacent ones of the electrical conductors 16 can be oriented so that the contact beams 22 thereof face in opposite directions, as shown in FIGS. 2, 10, 11, and 14.

The upper frame 18 of each IMLA 14 is molded around the lead portions 24 of the associated electrical conductors 16, proximate the associated contact beams 22, as shown in FIGS. 8, 11, 14, and 15. The upper frame 18 has a plurality of cylindrical projections 30 formed thereon. The upper frame 18 also includes a plurality of cylindrical pockets or recesses 32. The projections 30 and the recesses 32 are arranged in an alternating manner on both sides of the upper frame 18, so that the projections 30 of each IMLA 14 are disposed within corresponding recesses 32 of the adjacent IMLAs 14 when the connector 10 is assembled. The projections 30 and the recesses 32 are sized so that each projection 30 fits snugly within the corresponding recess 32. The engagement of the projections 30 and the periphery of the associated recesses 32 of the adjacent IMLAs 14 helps to locate and restrain each IMLA 14 in relation to the adjacent IMLAs 14.

The lower frame 20 of each IMLA 14 is molded around the lead portions 24 of the associated electrical conductors 16, proximate the associated posts 26, as shown in FIGS. 8 and 10-15. The lower frame 20 has a plurality of rectangular projections 34 formed thereon. The upper frame 18 also includes a plurality of rectangular pockets or recesses 36. The projections 34 and the recesses 36 are arranged in an alternating manner on both sides of the lower frame 20, so that the projections 34 of each IMLA 14 are disposed in corresponding recesses 36 of the adjacent IMLAs 14 when the connector 10 is assembled. The projections 30 and the recesses 32 are sized so that each projection 30 fits snugly within the corresponding recess 32. The engagement of the projections 32 and the periphery of the associated recesses 34 of the adjacent IMLAs 14 helps to locate and restrain each IMLA 14 in relation to the adjacent IMLAs 14.

Figure 12:
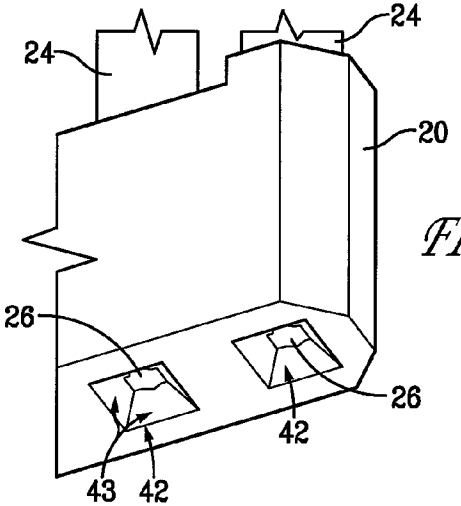
FIG. 12 is a magnified view of the area designated "A" in FIG. 11, depicting the insert molded leadframe assembly without solder balls.
Figure 13:
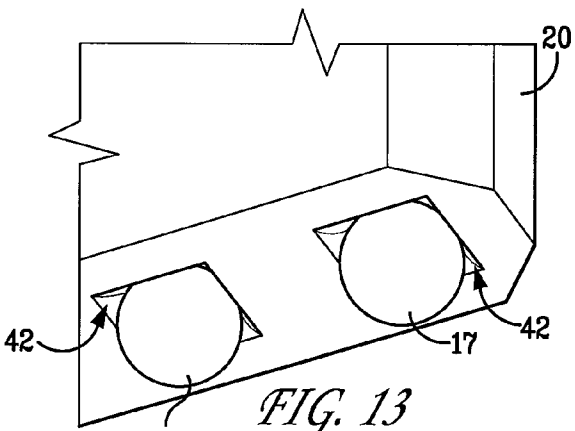
FIG. 13 is a magnified view of the area designated "A" in FIG. 11, depicting the insert molded leadframe assembly with solder balls.
Figure 11:
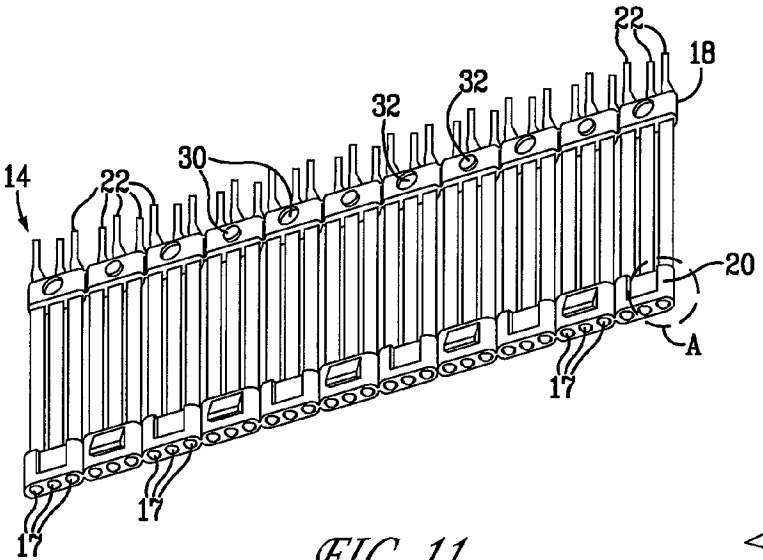
FIG. 11 is a bottom perspective view of the insert molded leadframe assembly shown in FIGS. 2 and 7-10.
Figure 14:
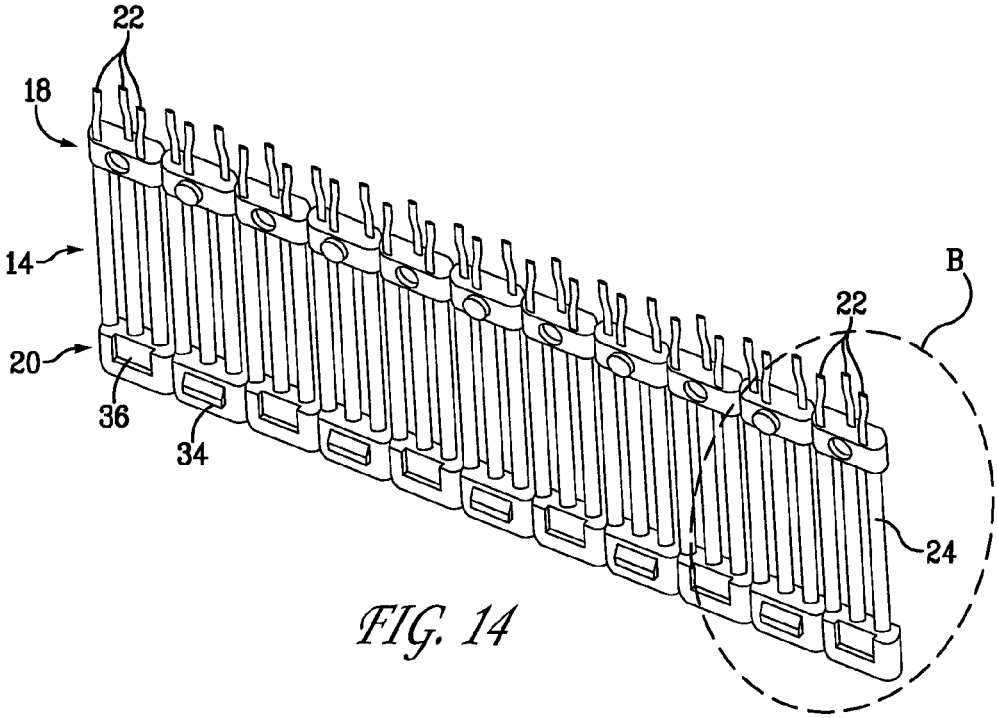
FIG. 14 is a top perspective view of the insert molded leadframe assembly shown in FIGS. 2 and 7-13.
Figure 15:
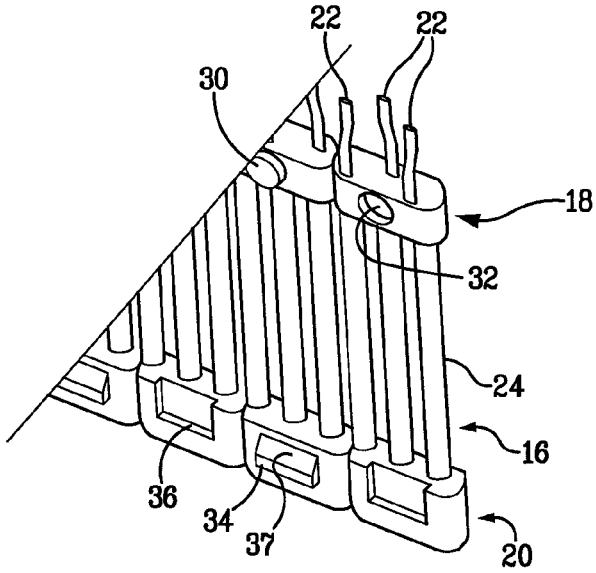
FIG. 15 is a magnified view of the area designated "B" in FIG. 14.
Figure 16:
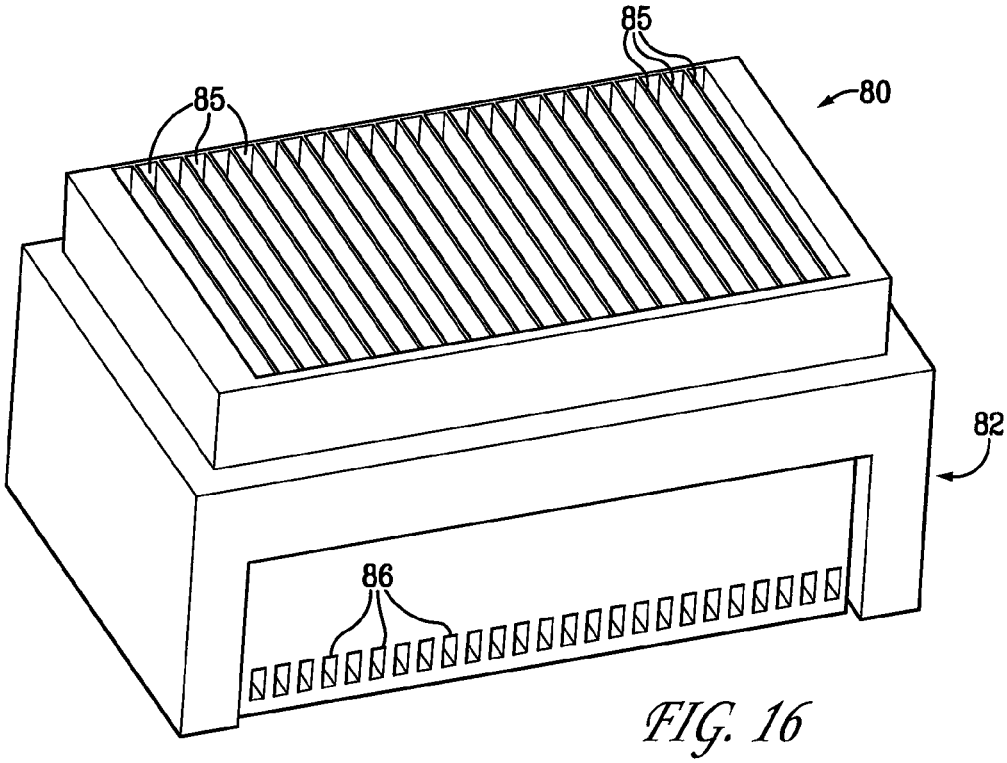
FIG. 16 is a top perspective view of an alternative embodiment of the electrical connector shown in FIG. 1.
Figure 17:
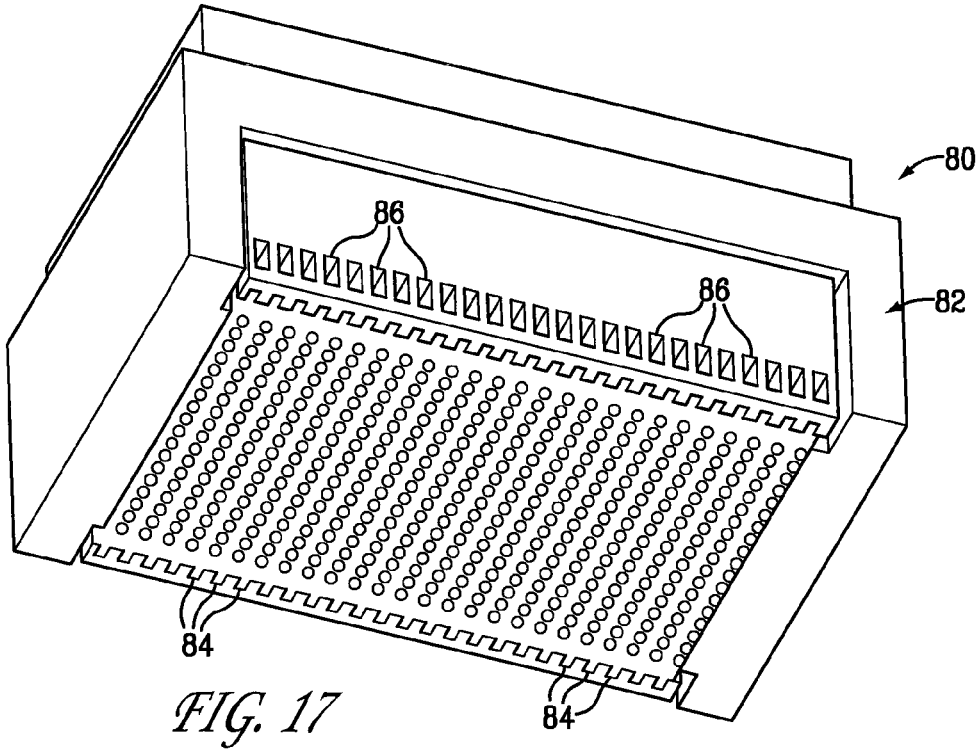
FIG. 17 is a bottom perspective view of the connector shown in FIG. 16.
Figure 19:
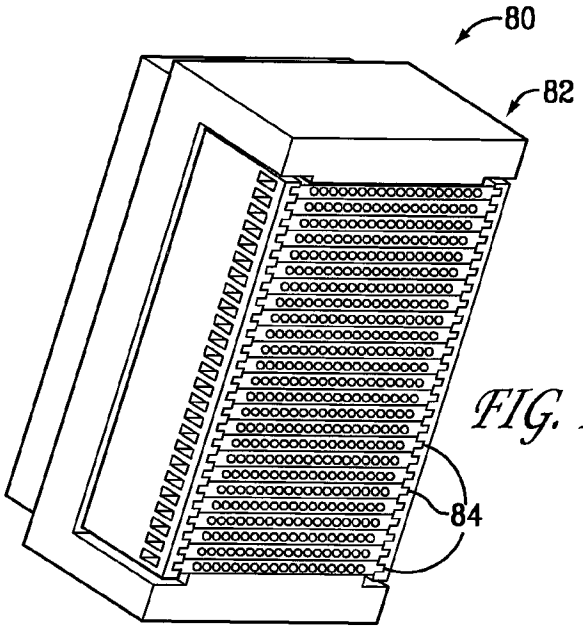
FIG. 19 is a bottom perspective view of the connector shown in FIGS. 16-18.
Figure 21:
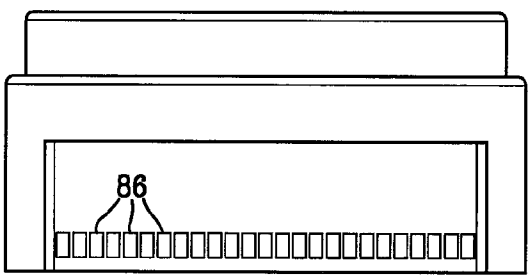
FIG. 21 is a side view of the connector shown in FIGS. 16-20, from a perspective rotated approximately ninety degrees form the perspective of FIG. 20.
Figure 18:
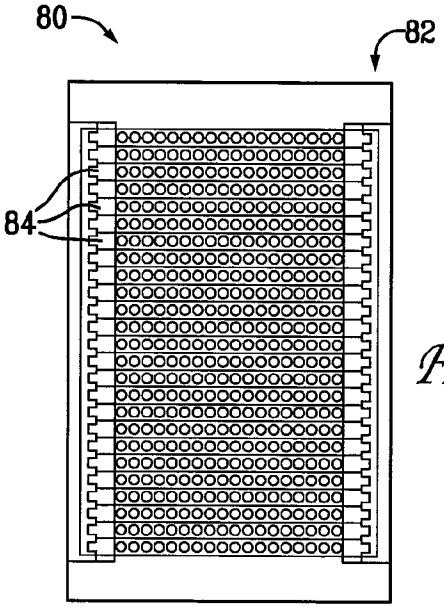
FIG. 18 is a bottom view of the connector shown in FIGS. 16 and 17.
Figure 20:
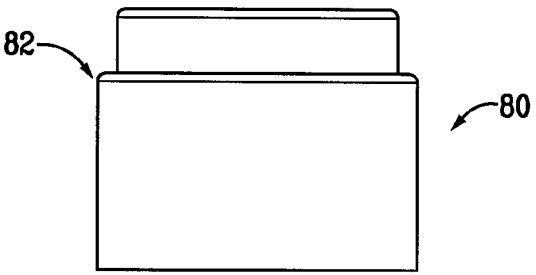
FIG. 20 is a side view of the connector shown in FIGS. 16-19.

The lower frame 20 has a plurality of pockets 42 formed therein, as shown in FIGS. 12 and 13. Each post 26 is located, in part, within an associated one of the pockets 42. Each pocket 40 is defined by four substantially flat surfaces 43, as shown in FIG. 12. Each surface 43 is angled in relation to the longitudinal centerline of the associated post 26.

Each solder ball 17 is positioned, in part, within an associated pocket 42 of the lower frame 20. The solder balls 17 are subjected to a solder reflow process after the connector 10 has been placed on its mating substrate (not shown). The solder reflow process melts the solder balls 17. The molten solder, upon cooling, forms solder connections between the electrical conductors 16 and associated contact pads on the mating substrate. The angled surfaces 43 of the pockets 42 help to locate the solder balls 17 and the molten solder during the reflow process, and thereby assist in the proper formation of the resulting solder connections.

Integrating the pockets 42 into the lower frame 20 of each IMLA 14 can obviate the need for a separate structure in addition to the housing 12, or for additional structure in the housing 12 itself, to accommodate the solder balls 17. Moreover, the IMLAs 14 can be molded in continuous strips and then cut to a desired length to accommodate differently sized housings 12 used in different applications, thereby obviating the need for different tooling to manufacture IMLAs 14 of different lengths.

Figure 4:
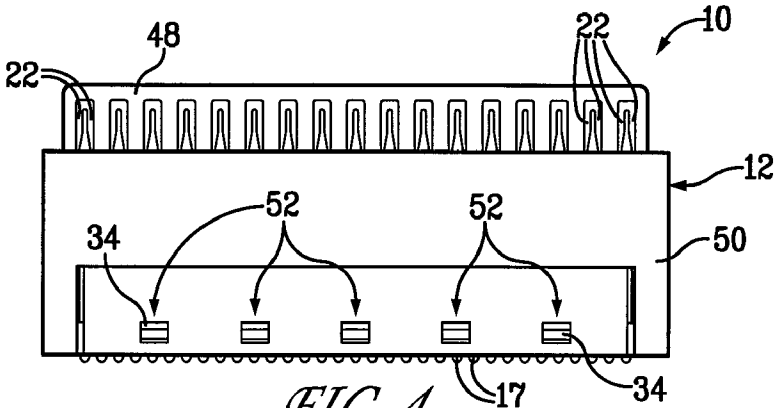
FIG. 4 is a side view of the connector shown in FIGS. 1-3.
Figure 6:
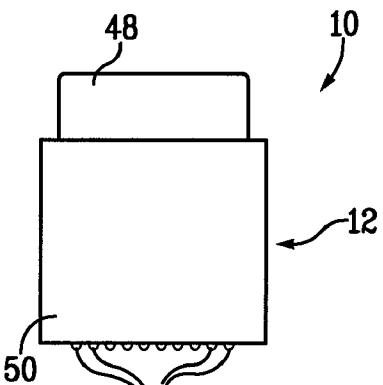
FIG. 6 is a side view of the connector shown in FIGS. 1-5, from a perspective rotated approximately ninety degrees form the perspective of FIG. 4.

The housing 12 includes an upper portion 48 and a lower portion 50. Penetrations 52 can be formed in a sidewall of the lower portion 50, as shown in FIGS. 1 and 4. Each penetration 52 receives an associated projection 34 of one of the outermost IMLAs 14. Interference between the projections 34 and the peripheral surfaces of the penetrations 52 helps to retain the IMLAs 14 in the housing 12.

Figure 3:
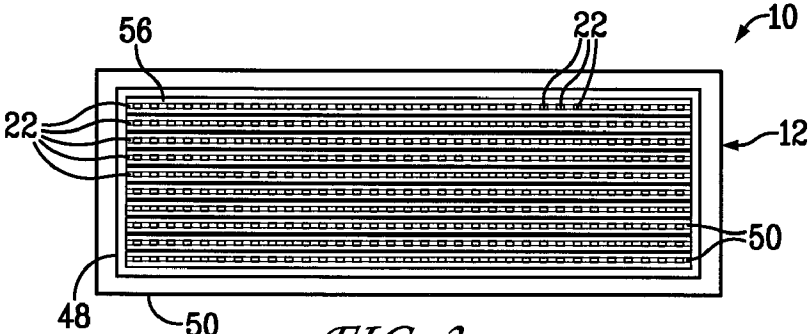
FIG. 3 is a top view of the connector shown in FIGS. 1 and 2.
Figure 5:
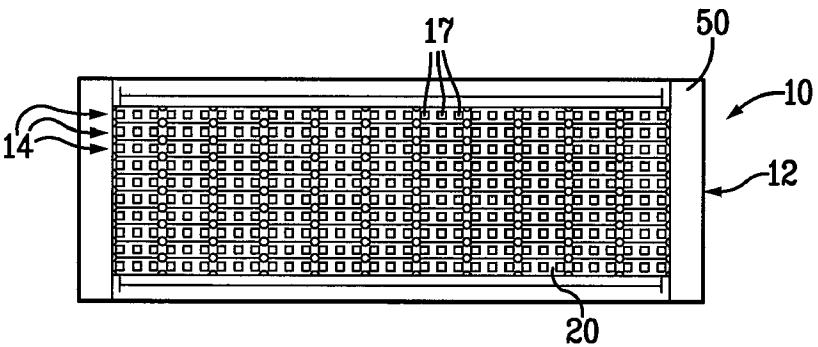
FIG. 5 is a bottom view of the connector shown in FIGS. 1-4.
Figure 7:
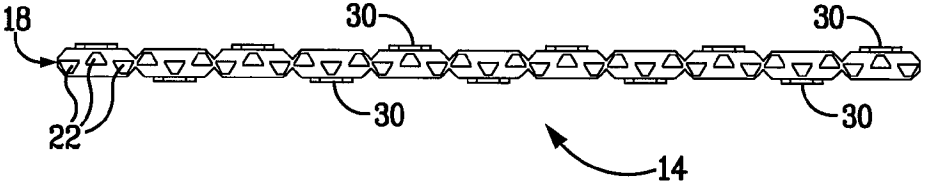
FIG. 7 is a top view of one of the insert molded leadframe assemblies shown in FIG. 2.
Figure 8:
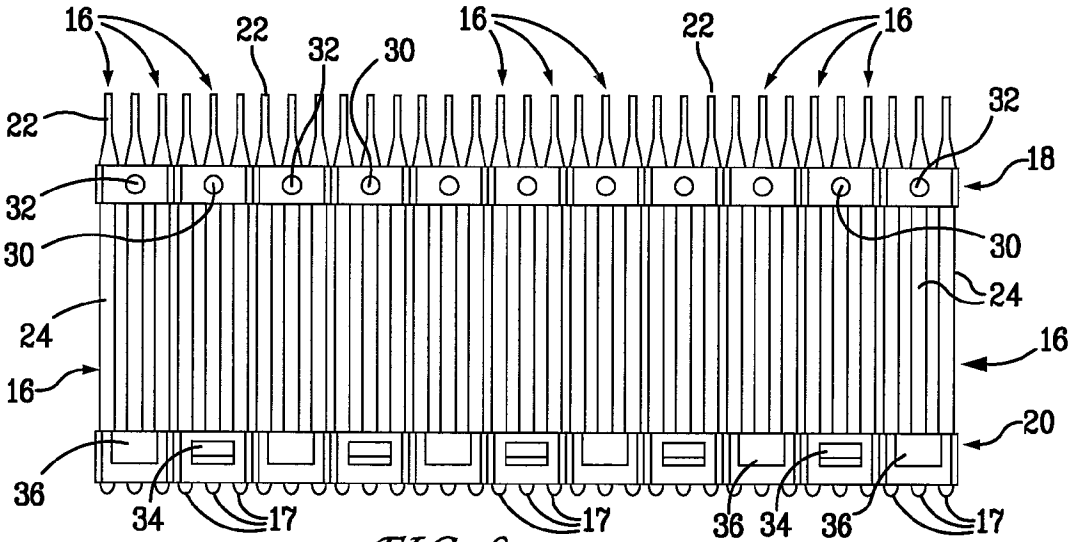
FIG. 8 is a side view of the insert molded leadframe assembly shown in FIGS. 2 and 7.
Figure 10:
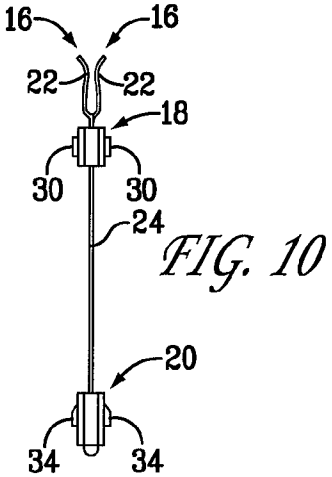
FIG. 10 is a side view of the insert molded leadframe assembly shown in FIGS. 2 and 7-9, from a perspective rotated approximately ninety degrees form the perspective of FIG. 8.
Figure 9:
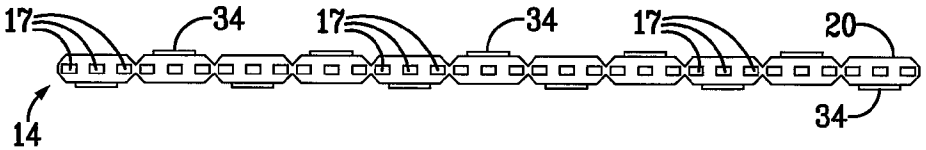
FIG. 9 is a bottom view of the insert molded leadframe assembly shown in FIGS. 2, 7, and 8.

The contact beams 22 of the electrical conductors 16 are located within the upper portion 48 of the housing 12. The upper portion 48 has slots 56 formed therein, as shown in FIGS. 1 and 3. Each slot 56 extends along the lengthwise direction of the upper portion 48, and is positioned above an associated IMLA 14. The slots 56 provide contacts of a mating connector (not shown) with access to the contact beams 22. The slots 56 also provide clearance between the contact beams 22 and the adjacent surfaces of the upper portion 48 of the housing 12, to accommodate the deflection of the contact beams 22 that occurs when the contact beams 22 are mated with the contacts of the mating connector.

FIGS. 16-21 depict an alternative embodiment of the connector 10 in the form of a connector 80. The connector 80 includes a housing 82, and a plurality of IMLAs 84. The IMLAs 84 are shorter than the IMLAs 14, so that the IMLAs 84 can be oriented substantially perpendicular to the lengthwise direction of the housing 82. The IMLAs 84 otherwise are substantially similar to the IMLAs 14.

The housing 82 has slots 85 formed therein. Each slot 85 extends along a direction substantially perpendicular to the lengthwise direction of the housing 82, and is positioned above an associated IMLA 84. The slots 85 provide contacts of a mating connector (not shown) with access to contact beams of the IMLAs 84.

The housing 82 has penetrations 86 formed therein. Each penetration 86 receives an end of a lower frame of an associated one of the IMLAs 84, to retain the IMLAs 84 in the housing 82.

FIGS. 22 through 31 depict another alternative embodiment in the form of an electrical connector 100. The connector 100 includes a first half 102, and a second half 104 that mates with the first half 102. The first half 102 and the second half 104 are hermaphroditic, i.e., the first half 102 and the second half 104 are non-gender-specific.

The first half 102 and the second half 104 of the connector 100 are substantially identical. The following comments concerning the components of the first half 102 apply equally to the second half 104, unless otherwise noted.

The first half 102 comprises a housing 106, and a plurality of IMLAs 108 contained within the housing 106. The connector 100 is depicted with six of the IMLAs 108 for exemplary purposes only; alternative embodiments can include more, or less than six of the IMLAs 108.

The housing 106 of the first half 102 is configured to mate with a substantially identical housing 106 of the second half 104. Each housing 106 includes a sidewall 112. The sidewall 112 includes a first portion 114 and a second portion 116 that together form the top of the sidewall 112 (from the perspective of FIG. 23). The first portion 114 is thinned so that the first portion 112 is recessed in relation to the outwardly-facing surfaces of the sidewall 112, and defines an outwardly-facing recess 117, as shown in FIG. 23. The second portion 116 is thinned so that the second portion 116 is recessed in relation of the inwardly-facing surfaces of the sidewall 112, and defines an inwardly-facing recess 1 18.

The first portion 114 of the sidewall 112 of each housing 106 is received within the recess 118 of the other housing 106 when the first and second halves 102, 104 are mated. The second portion 116 of the sidewall 112 of each housing 106 is received within the recess 117 of the other housing 106 when the first and second halves 102, 104 are mated. The first and second portions 114, 116 and the recesses 117, 118 provide a visual indication that the first and second halves 102, 104 are properly oriented during mating, and help to guide the first and second halves 102, 104 during mating.

Each housing 106 also includes a first end portion 120 and a second end portion 122, as shown in FIGS. 22-24. The first and second end portions 120, 122 each have a bore 124 formed therein. A pin 125, shown in FIGS. 22 and 23, is fit snugly within the bore 124 of the first end portion 120 of each housing 106. The pin 125 fits snugly within the bore 124 of the second end portion 122 of the other housing 106 when the first half 102 and the second half 104 are mated. The pins 124 help to guide the first and second halves 102, 104 as the first and second halves 102, 104 are mated. Moreover, friction between the pins 124 and the peripheral surfaces of the bores 124 helps to maintain the first and second halves 102, 104 in a mated condition.

The second end portion 122 extends over substantially the entire height of the housing 106, as shown in FIG. 24. The first end portion 120 is relatively short in comparison to the second end portion 122. More particularly, the top of the second end portion 122 is approximately even with the bottom of the first portion 114 of the sidewall 112 (from the perspective of FIG. 24). This feature prevents the first end portion 120 of each housing 106 from interfering with the second end portion 122 of the other housing 106 when the first and second halves 102, 104 are mated.

Figure 29:
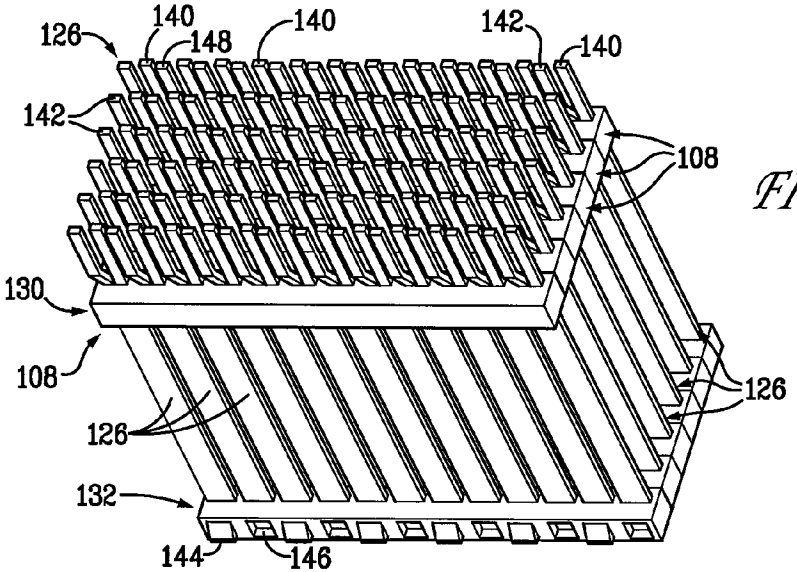
FIG. 29 is a top perspective view of insert molded leadframe assemblies of the connector shown in FIGS. 22-28.
Figure 30:
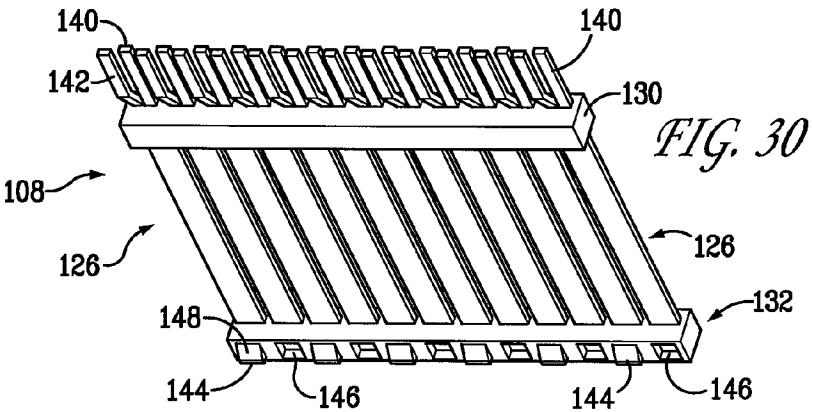
FIG. 30 is a top perspective view of one of the insert molded leadframe assemblies shown in FIG. 29.

Each IMLA 108 includes a plurality of electrical conductors 126, and a plurality of fusible elements such as solder balls 128. The IMLAs 108 are depicted in FIGS. 29 and 30. Each IMLA 108 also includes an electrically-insulative upper frame 130, and an electrically-insulative lower frame 132. The IMLAs 108 are depicted with twelve of the electrical conductors 126 and twelve of the solder balls 128 for exemplary purposes only; the IMLAs 108 of alternative embodiments can include more, or less than twelve of the electrical conductors 126 and solder balls 128.

Figure 28:
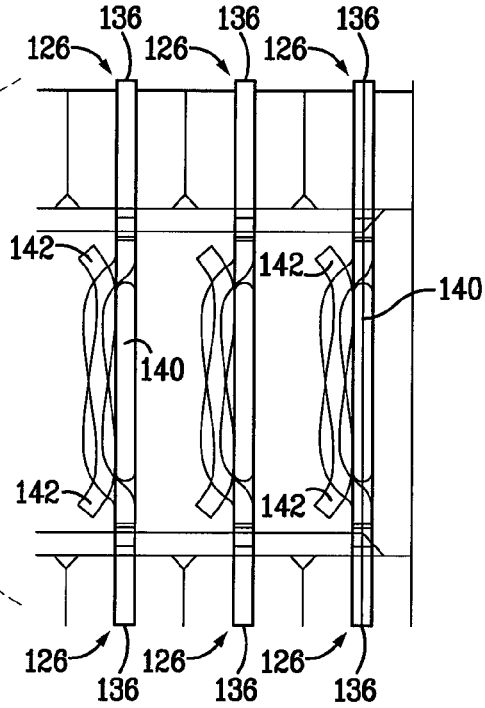
FIG. 28 is a magnified view of the area designated "D" in FIG. 27, with the housings of the first and second halves of the connector made transparent to reveal the mated electrical conductors within the housings.
Figure 31:
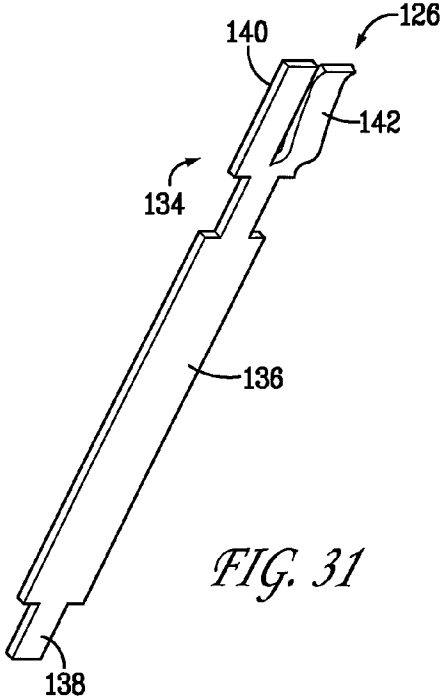
FIG. 31 is a top perspective view of an electrical conductor of the insert molded leadframe assembly shown in FIGS. 29 and 30.

Each electrical conductor 126 includes a contact portion 134, a lead portion 136 that adjoins the contact portion 134, and a post 138 that adjoins the end of the lead portion 136 distal the contact portion 134, as shown in FIG. 31. The contact portion 134 includes a first contact beam 140 and a second contact beam 142 positioned in a side by side relationship. The first contact beam 140 is substantially straight. The second contact beam 142 is angled in relation to the longitudinal axis of the lead portion 136, as shown in FIGS. 28 and 31.

The upper frame 130 of each IMLA 108 is molded around the lead portions 136 of the associated electrical conductors 126, proximate the associated contact portion 134, as shown in FIG. 30.

The lower frame 132 of each IMLA 108 is molded around the lead portions 136 of the associated electrical conductors 126, proximate the associated post 138, as shown in FIG. 30. The lower frame 132 has a plurality of projections 144 formed thereon. The lower frame 132 also has a plurality of pockets or recesses 146 formed therein. The projections 144 and the recesses 146 are arranged in an alternating manner on both sides of the lower frame 132. This arrangement causes the projections 144 of each IMLA 108 to become disposed within corresponding recesses 146 of the adjacent IMLAs 108 when the IMLAs 108 are positioned within their associated housings 106.

The projections 144 and the recesses 146 are sized so that each projection 144 fits snugly within the corresponding recess 146 of the adjacent IMLA 108. The engagement of the projections 144 and the periphery of the associated recesses 146 of the adjacent IMLAs 108 helps to locate and restrain each IMLA 108 in relation to the adjacent IMLAs 108. Each projection 144 can have a major surface 148 that is angled in relation to the vertical direction as shown in FIGS. 29 and 30, to facilitate assembly and disassembly of the IMLAs 108 within their associated housings 106.

Each housing 106 can have a plurality of inwardly-facing recesses (not shown) formed therein for receiving the projections 144 of the outermost IMLAs. Interference between the projections 144 and the peripheral surfaces of the recesses can help retain the IMLAs 108 in the housing 106.

The upper frames 130 of alternative embodiments can be equipped with recesses and projections such as the recesses 146 and the projections 144 of the lower frames 132.

Figure 26:
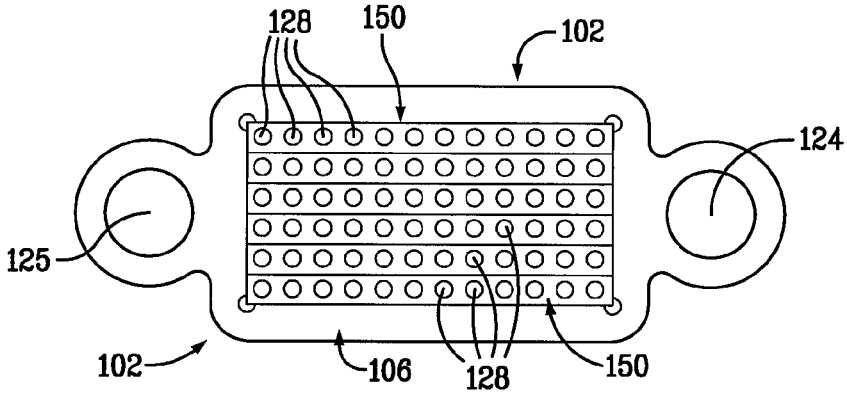
FIG. 26 is a top view of the first half of the connector shown in FIGS. 22-25.
Figure 27:
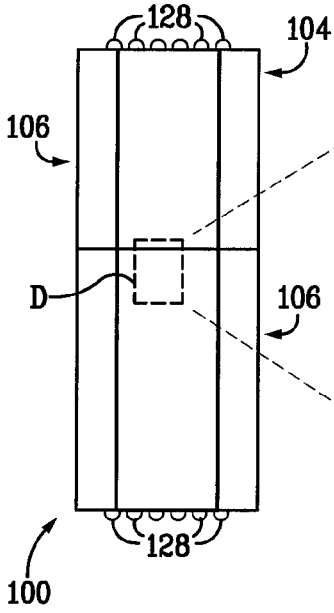
FIG. 27 is a side view of the connector shown in FIGS. 22-26, depicting the first and second halves of the connector in a fully-mated condition, and from a perspective rotated approximately ninety degrees form the perspective of FIG. 24.

The lower frame 132 of each IMLA 108 has a plurality of pockets 150 formed therein, as shown in FIG. 26. Each post 138 of the contacts 126 is located, in part, within an associated one of the pockets 150. Each post 138 has one of the solder balls 128 attached thereto, so that the solder ball 128 is positioned in part within the associated pocket 150. The pockets 150 can be substantially similar to the pockets 42 in the lower frames 30 of the connector 10 described above. The solder balls 128 can be reflowed to form solder connections between the first and second halves 102, 104 of the connector 100 and their respective mounting substrates (not shown).

The configuration of the contact portions 134 of the electrical conductor 126 permits each of the electrical conductors 126 of the first half 102 to mate with an associated electrical conductor 126 of the second half 104 when the first and second halves 102, 104 are mated. In particular, the angled second contact beam 142 of each electrical conductor 126 of the first half 102 contacts and mates with a substantially straight first contact beam 140 of an associated electrical conductor 126 of the second half 104 when the first and second halves 102, 104 are mated, as shown in FIGS. 25 and 28. The first contact beam 140 of each electrical conductor 126 of the first half 102 likewise contacts the second contact beam 142 of an associated one of the electrical conductors 126 of the second half 104 when the first and second halves 102, 104 are mated.

The contact between the associated first and second contact beams 140, 142 of the first and second halves 102, 104 causes each of the second contact beams 142 to resiliently deflect outwardly, away from the associated first contact beam 140, as the first and second halves 102, 104 are mated. The contact between the associated first and second contact beams 140, 142 also causes each of the first contact beams 140 to resiliently deflect outwardly, away from the associated second contact beam 142. The resilient deflection of the first and second contact beams 140, 142 results in a contact force between the associated first and second contact beams 140, 142.

The identical configuration of the first and second halves 102, 104 of the connector 100 helps to minimize the number of different types of parts needed to construct the connector 100, in comparison to a non-hermaphroditic connector of comparable capabilities. Manufacturing, tooling, and inventory-related costs thereby can potentially be reduced due to the identical configuration of the first and second halves 102, 104. Moreover, the IMLAs 108 can be molded in continuous strips and then cut to a desired length, to accommodate differently sized housings 106 used in different applications.

FIGS. 32 through 45 depict another alternative embodiment in the form of an electrical connector 200. The connector 200 includes a first half 202, and a second half 204 that mates with the first half 202. The first half 202 and the second half 204 are hermaphroditic.

The first half 202 and the second half 204 of the connector 200 are substantially identical. The following comments concerning the components of the first half 202 apply equally to the second half 204, unless otherwise noted.

The first half 202 comprises a housing 206, and a plurality of IMLAs 208 contained within the housing 206. The first half 202 is depicted with less than all of its IMLAs 208, for clarity of illustration.

Figures 32, 33, 34, 35, 41:
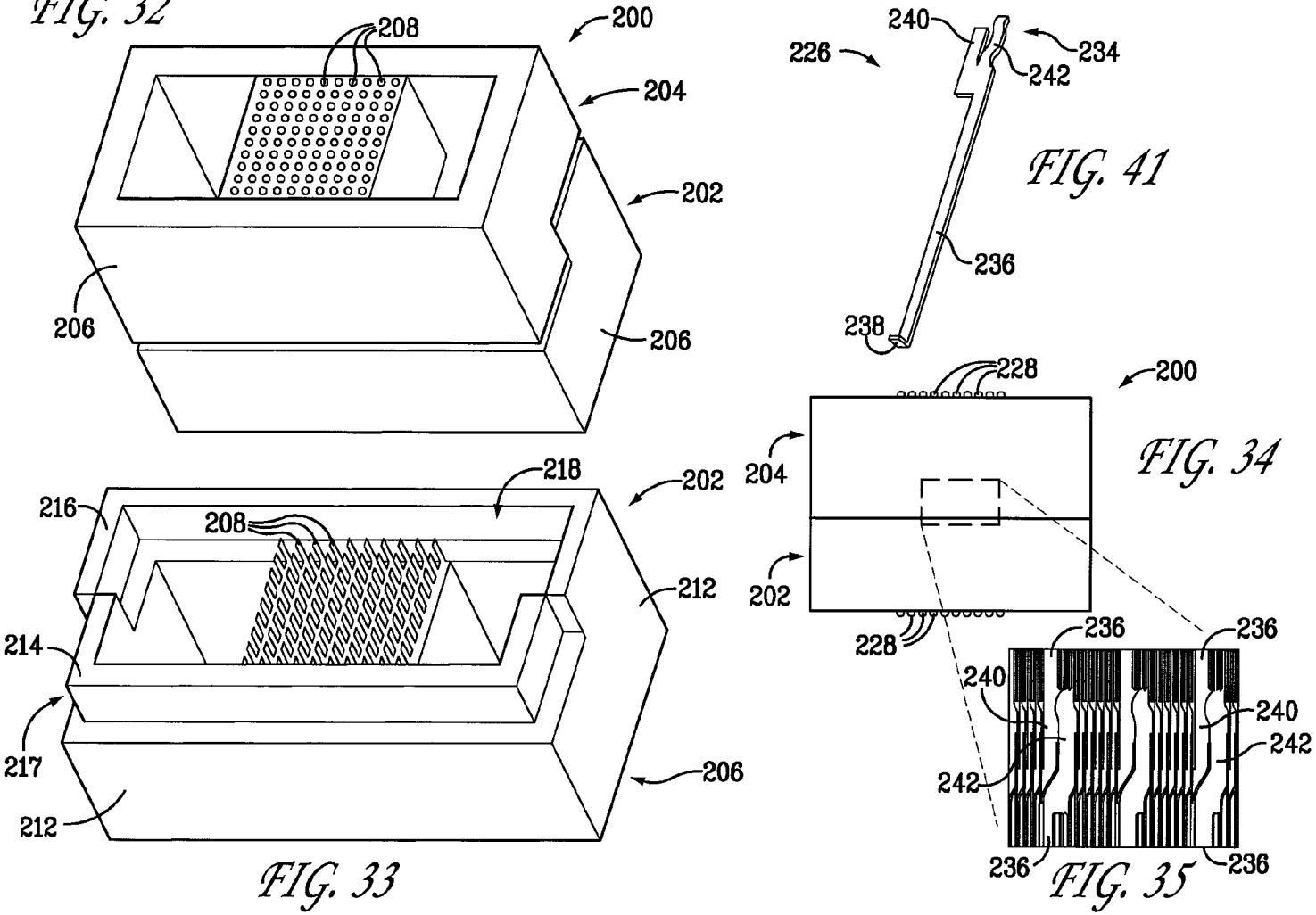
FIG. 32 is a top perspective view of another alternative embodiment of the electrical connector shown in FIG. 1, depicting first and second halves of the connector in a partially mated condition.
FIG. 33 is a top perspective view of the first half of the connector shown in FIG. 22.
FIG. 34 is a side view of the connector shown in FIGS. 32 and 33, depicting the first and second halves of the connector in a fully mated condition.
FIG. 35 is a magnified view of the area designated "E" in FIG. 34, with housings of the first and second halves of the connector made transparent to reveal mated electrical conductors within the housings.
FIG. 41 is a top perspective view of an electrical conductor of the insert molded leadframe assembly shown in FIGS. 39 and 40.
Figure 36:
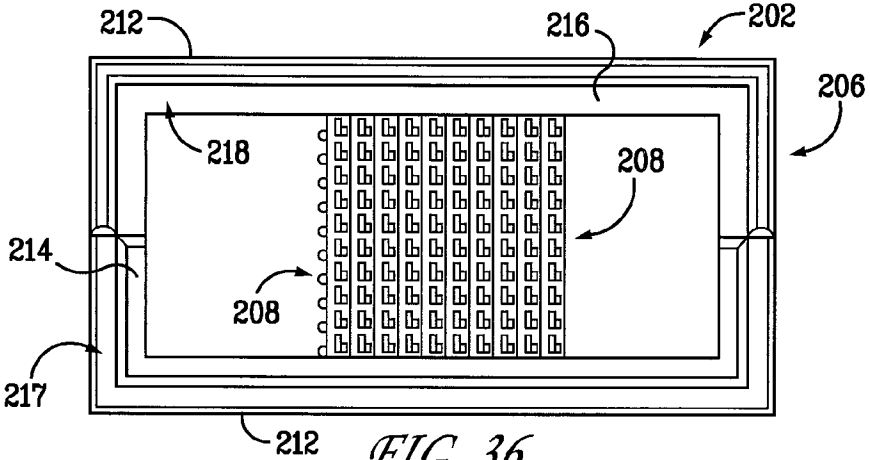
FIG. 36 is a top view of the first half of the connector shown in FIGS. 32-35.
Figure 37:
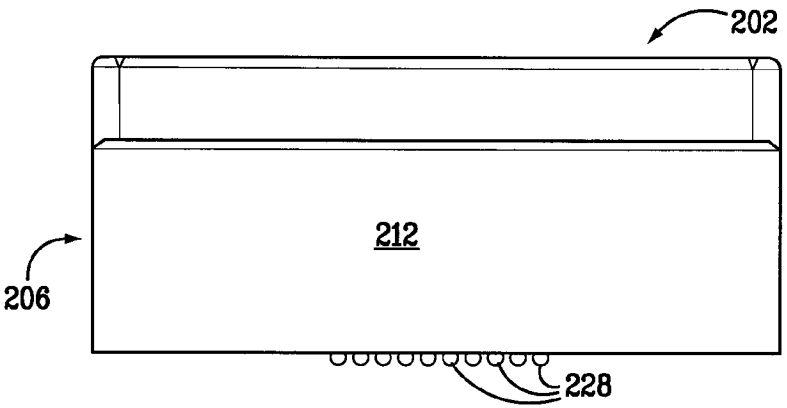
FIG. 37 is a side view of the first half of the connector shown in FIGS. 32-36.
Figure 38:
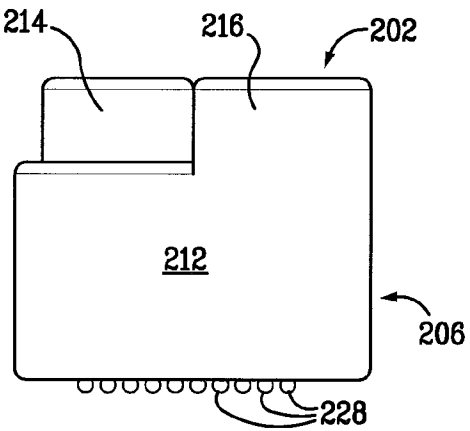
FIG. 38 is a side view of the first half of the connector shown in FIGS. 32-37, from a perspective rotated approximately ninety degrees from the perspective of FIG. 37.

The housing 206 of the first half 202 is configured to mate with a substantially identical housing 206 of the second half 204. Each housing 206 includes a sidewall 212. The sidewall 212 includes a first portion 214 and a second portion 216 that together form the top of the sidewall 212 (from the perspective of FIG. 33). The first portion 214 is thinned so that the first portion 212 is recessed in relation to the outwardly-facing surfaces of the sidewall 212, and defines an outwardly-facing recess 217 as shown in FIGS. 33 and 36. The second portion 216 is thinned so that the second portion 216 is recessed in relation of the inwardly-facing surfaces of the sidewall 212, and defines an inwardly-facing recess 218.

The first portion 214 of the sidewall 212 of each housing 206 is received within the recess 218 of the other housing 106 when the first and second halves 102, 104 are mated. The second portion 216 of the sidewall 212 of each housing 206 is received within the recess 217 of the other housing 206 when the first and second halves 202, 204 are mated. The first and second portions 214, 216 and the recesses 217, 218 provide a visual indication that the first and second halves 202, 204 are properly oriented during mating, and help to guide the first and second halves 202, 204 during mating.

Each IMLA 208 includes a plurality of electrical conductors 226, and a plurality of fusible elements such as solder balls 228, as shown in FIGS. 39-45. Each IMLA 208 also includes an electrically-insulative frame 230. The IMLAs 208 are depicted with ten of the electrical conductors 226 and ten of the solder balls 228 for exemplary purposes only; the IMLAs 208 of alternative embodiments can include more, or less than ten of the electrical conductors 226 and ten of the solder balls 228.

Each electrical conductor 226 includes a contact portion 234, and a lead portion 236 that adjoins the contact portion 234, as shown in FIGS. 41-43. Each electrical conductor 226 also includes a ball paddle 238. The ball paddle 238 adjoins the end of the lead portion 236 distal the contact portion 234, and is oriented substantially perpendicular to the longitudinal axis of the lead portion 236.

The contact portion 234 includes a first contact beam 240 and a second contact beam 242 positioned in a side by side relationship, as shown in FIG. 39-45. The first contact beam 240 is substantially straight. A portion of the second contact beam 242 is angled so that the second contact beam 242 is offset in relation to the longitudinal axis of the lead portion 236, as shown in FIGS. 43 and 45.

The frame 230 of each IMLA 208 is molded around the lead portions 236 of the associated electrical conductors 226. The upper and lower ends of each frame 230 are thickened in relation to the remainder of the frame 230 as shown in FIG. 45, to facilitate spacing between adjacent IMLAs 208.

Each ball paddle 238 of the electrical conductors 226 has one of the solder balls 228 attached thereto, as shown in FIGS. 39, 44, and 45. The solder balls 228 can be reflowed to form solder connections between the first and second halves 202, 204 of the connector 200 and their respective mounting substrates (not shown).

The configuration of the contact portions 234 of the electrical conductor 226 permits each of the electrical conductors 226 of the first half 202 to mate with an associated electrical conductor 226 of the second half 204 when the first and second halves 202, 204 are mated. In particular, the offset second contact beam 242 of each electrical conductor 226 of the first half 202 contacts and mates with a substantially straight first contact beam 240 of an associated electrical conductor 226 of the second half 204 when the first and second halves 202, 204 are mated, as shown in FIG. 36. The first contact beam 240 of each electrical conductor 226 of the first half 202 likewise contacts the second contact beam 242 of an associated one of the electrical conductors 226 of the second half 204 when the first and second halves 202, 204 are mated.

The contact between the associated first and second contact beams 240, 242 of the first and second halves 202, 204 causes each of the second contact beams 242 to resiliently deflect outwardly, away from the associated first contact beams 202, as the first and second halves 202, 204 are mated. The contact between the associated first and second contact beams 202, 204 also causes each of the first contact beams 202 to resiliently deflect outwardly, away from the associated second contact beam 204. The resilient deflection of the first and second contact beams 240, 242 results in a contact force between the associated first and second contact beams 240, 242.

The identical configuration of the first and second halves 202, 204 of the connector 200 helps to minimize the number of different types of parts needed to construct the connector 200, in comparison to a non-hermaphroditic connector of comparable capabilities. Moreover, the IMLAs 208 can be molded in continuous strips and then cut to a desired length, to accommodate differently sized housings 206 used in different applications.

Figure 46:
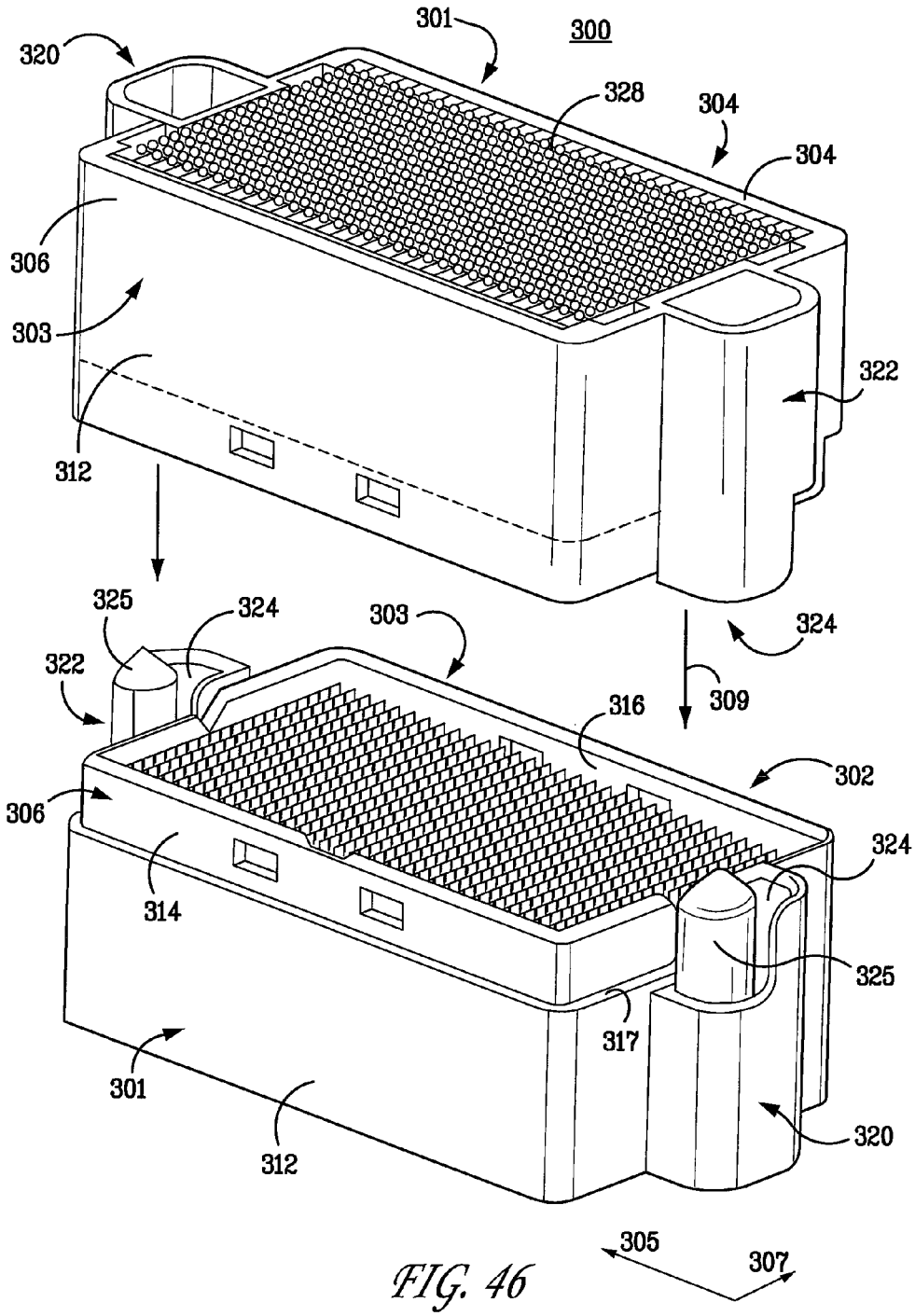
FIG. 46 is a perspective view of another alternative embodiment connector, depicting first and second connector portions of a connector, the connector portions in position to be mated together.
Figure 47:
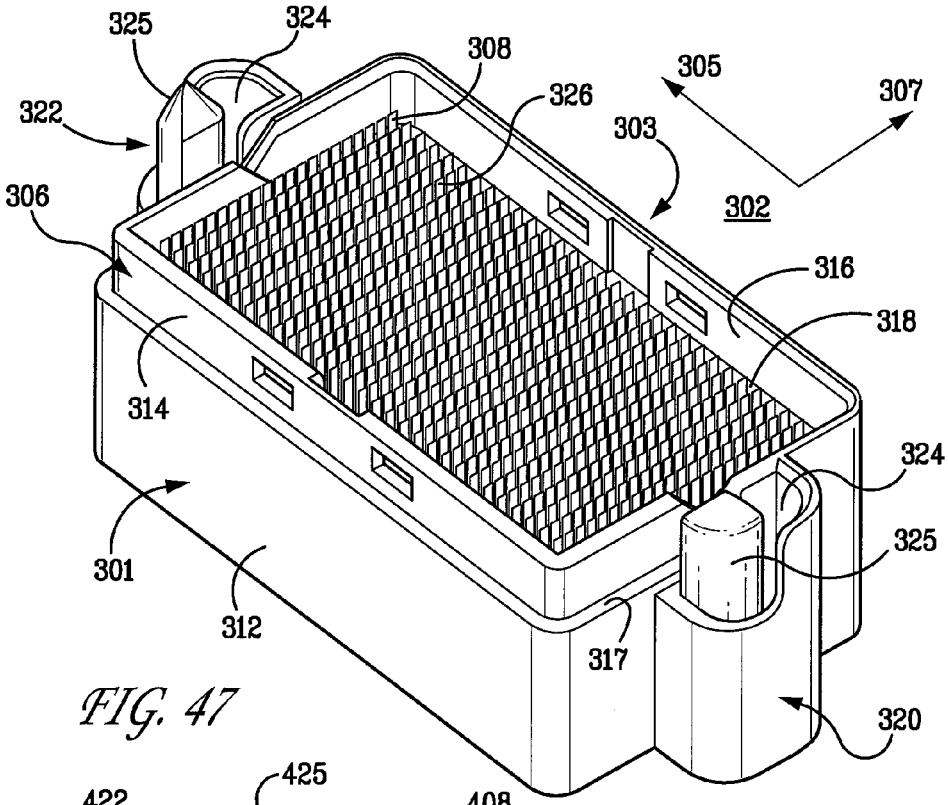
FIG. 47 is a perspective view of one of the connector portions shown in FIG. 46.

FIGS. 46 and 47 depict another alternative embodiment in the form of an electrical connector 300. The connector 300 may include a first connector portion 302 and a second connector portion 304 that mates with the first connector portion 302 in a mating direction 309. The first and second connector portions 302, 304 may each include one or more electrical conductors 326. The first connector portion 302 may be mounted to one surface, such as printed circuit board (not shown), and the second connector portion 304 may be mounted to another surface, such as another printed circuit board (not shown). The first and second connector portions 302, 304 may each be electrically and mechanically connected to the respective surfaces by any suitable means. For example, each electrical conductor 326 may include a solder ball 328 that may be soldered to a solder pad, or a compliant terminal end that may be inserted into a plated-through hole. The first connector portion 302 and the second connector portion 304 may be hermaphroditic, i.e., the first connector portion 302 and the second connector portion 304 may be non-gender-specific.

The first connector portion 302 and the second connector portion 304 of the connector 300 may be substantially identical. For example, the first connector portion 302 and the second connector portion 304 may include the same number, type and/or arrangement of electrical conductors 326. Moreover, the first connector portion 302 and the second connector portion 304 may include respective housings that each define an identical size, shape and/or feature. As such, the following comments concerning the components of the first connector portion 302 may apply equally to the second connector portion 304, unless otherwise noted.

It will be appreciated that the first and second connector portions 302,304 may be substantially identical notwithstanding minor physical and/or visual differences between the two connector portions. For example, the first and second connector portions 302, 304 may include different markings, engravings, manufacturing tolerances, and the like.

As shown in FIG. 46, the first connector portion 302 and the second connector portion 304 may each include a housing 306, which may be constructed of any suitable material, such as plastic. The housing 306 of the first connector portion 302 may be configured to mate with the housing 306 of the second connector portion 304, which may be substantially identical to the housing 306 of the first connector portion 302. Each housing 306 may include a first end 320 and a second end 322 that is opposite the first end 320 in a direction 305. Each housing 306 may also include a first side 301 and a second side 303 that is opposite the first side 301 in a direction 307. The direction 305, the direction 307 and the mating direction 309 may be substantially perpendicular to one another.

The first side 301 and the second side 303 of each housing 306 may each define a sidewall 312. The sidewall 312 of the first side 301 may include a first sidewall portion 314. The sidewall 312 of the second side 303 may include a second sidewall portion 316. Together, the first sidewall portion 314 and the second sidewall portion 316 may form the upper portion (from the perspective of FIG. 47) of the sidewall 312 of each housing 306. The first sidewall portion 314 may be thinned so that the first sidewall portion 314 is recessed in relation to the outwardly-facing surface of the first side 301 of the sidewall 312, thereby defining an outwardly-facing recess 317. The second sidewall portion 316 may be thinned so that the second sidewall portion 316 is recessed in relation to the inwardly-facing surfaces of the second side 303 of the sidewall 312, thereby defining an inwardly-facing recess 318.

When mating the first connector portion 302 with the second connector portion 304, the first sidewall portion 314 of the first connector portion 302 may be received within the second sidewall portion 316 of the second connector portion 304. Similarly, the first sidewall portion 314 of the second connector portion 304 may be received within the second sidewall portion 316 of the first connector portion 302. In addition, the outwardly-facing recess 317 of the first connector portion 302 may abut the inwardly-facing recess 318 of the second connector portion 304, and the outwardly-facing recess 317 of the second connector portion 304 may abut inwardly-facing recess 318 of the first connector portion 302.

As will be appreciated by one skilled in the art, the first connector portion 302 and the second connector portion 304 may require proper alignment before the two connector portions may be mated to one another in the mating direction 309. For example, the first connector portion 302 may not be connectable with the second connector portion 304 if the first sidewall portion 314 of the first connector portion 302 is aligned on the same side as the first sidewall portion 314 of the second connector portion 304. Rather, to mate the two connector portions to one another, either the first connector portion 302 or the second connector portions 304 may be rotated 180 degrees so that the first sidewall portion 314 of the first connector portion 302 is aligned on the same side as the second sidewall portion 316 of the second connector portion 304. Thus, the first sidewall portion 314, the second sidewall portion 316, the outwardly-facing recess 317, and/or the inwardly-facing recess 318 may provide a visual indication that the first connector portion 302 and the second connector portion 304 are properly oriented during mating. Moreover, the first sidewall portion 314 and the second sidewall portion 316 may help guide the first connector portion 302 and the second connector portion 304 during mating.

As noted above, each housing 306 may include the first end 320 and the second end 322. The first end 320 and the second end 322 may each have a bore 324 or hole formed therein. Additionally, the first end 320 and the second end 322 may each include a pin 325 adjacent to the respective bore 324. Each bore 324 and each pin 325 may generally extend along the mating direction 309, and each bore 324 may be sized and shaped to receive one of the pins 325. In other embodiments, the bore 324 and the pin 325 may be part of a guide assembly that is attached to the first and second ends 320, 322 of the housing 306.

It will be appreciated that the bores 324 and the pins 325 may define any suitable size or shape. For example, each of the pins 325 may have a circular, elliptical, square, or rectangular cross-section. Similarly, each of the bores 324 may define a circular, elliptical, square, or rectangular opening. In addition, each pin 325 may partially define the adjacent bore 324. The bores 324 and the pins 325 may be produced via any suitable process, such as a molding process.

As shown in FIG. 47, the bore 324 of the first end 320 may be adjacent to the pin 325 of the first end 320 in the direction 307. Similarly, the bore 324 of the second end 322 may be adjacent to the pin 325 of the second end 322 in the direction 307. In other embodiments, the relative positions of the pins 325 and the bores 324 on the first and second connector portions 302, 304 may be reversed, i.e., the pins 325 of the first and second ends 320, 322 may each be adjacent to the respective bores 324 in the direction 307. As shown in FIG. 46, when the first and second connector portions 302, 304 are mated, the bore 324 and the pin 325 of the first end 320 of the first connector portion 302 may be adjacent in the direction 307, while the bore 324 and the pin 325 of the second end 322 of the second connector portion 304 may be adjacent in a direction opposite the direction 307.

It will be appreciated that the arrangement of the bores 324 and the pins 325 on the housing 306 may prevent the first and second connector portions 302, 304 from being improperly oriented during mating. For example, the first and second connector portions 302, 304 may not be connectable to one another if the pins 325 of the first connector portion 302 are aligned on the same side as the pins 325 of the second connector portion 304. Thus, like the first and second sidewall portions 314, 316, the arrangement of the bores 324 and the pins 325 may provide a visual indication that the first connector portion 302 and the second connector portion 304 are properly oriented during mating.

When the first and second connector portions 302, 304 are mated, the pin 325 of the first end 320 of the first connector portion 302 may fit snugly within the bore 324 of the second end 322 of the second connector portion 304, and the pin 325 of the second end 322 of the first connector portion 302 may fit snugly within the bore 324 of the first end 320 of the second connector portion 304. Likewise, the pin 325 of the first end 320 of the second connector portion 304 may fit snugly within the bore 324 of the second end 322 of the first connector portion 302, and the pin 325 of the second end 322 of the second connector portion 304 may fit snugly within the bore 324 of the first end 320 of the first connector portion 302.

Thus, as will be appreciated by one skilled in the art, the bores 324 and the pins 325 may help to guide the first connector portion 302 and the second connector portion 304 as the two connector portions are mated. Moreover, friction between the outer-mating-surfaces of the pins 325 and the inner-mating-surfaces of the bores 324 may create a retention force that inhibits the first connector portion 302 and the second connector portion 304 from separating from one another when the pins 325 are at least partially received in the bores 324. That is, the retention force may act in a direction opposite the mating direction 309. Thus, the retention force created by the bores 324 and the pins 325 may help to maintain the first connector portion 302 and the second connector 304 in a mated condition.

The first connector portion 302 and the second connector portion 304 may each include one or more IMLAs 308, which may be the same as or similar to IMLAs 14, 108, and/or 208, for example. Each IMLA 308 may include one or more electrical conductors 326, which may be the same as or similar to the electrical conductors 16, 126, and/or 226, for example. Each IMLA 308 may further include one or more fusible elements, such as solder balls 328, which may be the same as or similar to the solder balls 17, 128, and/or 228, for example.

Each housing 306 may include one or more inwardly-facing recesses (not shown) formed therein for receiving one or more projections (e.g., the projections 144) of the outermost IMLAs 308. Interference between the projections and the peripheral surfaces of the inwardly-facing recesses may help retain the IMLAs 308 in the housing 306.

In contrast to non-hermaphroditic connectors having comparable electrical capabilities to the disclosed connector 300, the identical configuration of the first and second connector portions 302, 304 of the connector 300 helps to minimize the number of different types of parts needed to construct the connector 300. As such, manufacturing, tooling, and/or inventory-related costs may potentially be reduced due to the identical configuration of the first and second connector portions 302, 304. Moreover, the IMLAs 308 may be molded in continuous strips and then cut to a desired length, to accommodate differently sized housings 306 used in different applications.

Figure 48:
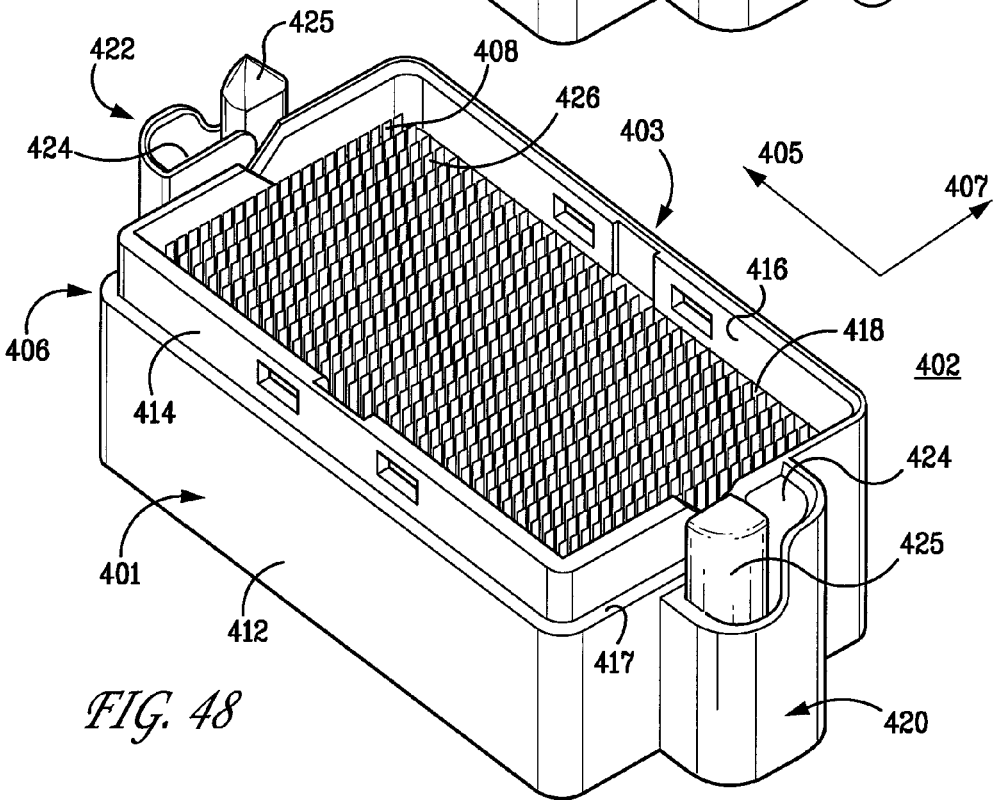
FIG. 48 is a perspective view of an alternative embodiment of the connector portion shown in FIG. 47.

FIG. 48 depicts a connector portion 402 according to an alternative embodiment. The connector portion 402 may be substantially similar to the first connector portion 302 described above, i.e., the connector portion 402 generally may include all of the same elements as the connector portion 302. Thus, like the first connector portion 302, the connector portion 402 may be configured to mate with another connector portion (not shown) that is substantially identical to the connector portion 402. As such, the foregoing description of the first and second connector portions 302, 304 may apply equally to the connector portion 402, unless otherwise noted.

The connector portion 402 may include a housing 406 with a first end 420 and a second end 422 that is opposite the first end 420 in a direction 405. The housing 406 may also include a first side 401 and a second side 403 that is opposite the first side 401 in a direction 407. The direction 405 and the direction 407 may be substantially perpendicular to one another.

The first side 401 and the second side 403 of the housing 406 may each define a sidewall 412. The sidewall 412 of the first side 401 may include a first sidewall portion 414. The sidewall 412 of the second side 403 may include a second sidewall portion 416. Together, the first sidewall portion 414 and the second sidewall portion 416 may form the upper portion of the sidewall 412 of the housing 406. The first sidewall portion 414 may be thinned so that the first sidewall portion 414 is recessed in relation to the outwardly-facing surface of the first side 401 of the sidewall 412, thereby defining an outwardly-facing recess 417. The second sidewall portion 416 may be thinned so that the second sidewall portion 416 is recessed in relation to the inwardly-facing surfaces of the second side 403 of the sidewall 412, thereby defining an inwardly-facing recess 418.

The first end 420 and the second end 422 of the housing 406 may each have a bore 424 formed therein. Additionally, the first end 420 and the second end 422 may each include a pin 425 adjacent to the respective bore 424. In other embodiments, the bore 424 and the pin 425 may be part of a guide assembly that is attached to the first and second ends 420, 422 of the housing 406.

As shown in FIG. 48, the bore 424 of the first end 420 may be adjacent to the pin 425 of the first end 420 in the direction 407. Unlike the first connector portion 302, the bore 424 of the second end 422 of the connector portion 402 may be adjacent to the pin 425 of the second end 422 in a direction that is opposite the direction 307 (i.e., the arrangement of the pins 425 and the bores 424 at the first and second ends 420, 422 may be mirror images of one another). Like the first and second connector portions 302, 304 shown in FIG. 46, however, the connector portion 402 may be mated with another connector portion that is substantially identical to the connector portion 402.

The connector portion 402 may include one or more IMLAs 408, which may be the same as or similar to IMLAs 14, 108, 208, and/or 308, for example. Each IMLA 408 may include one or more electrical conductors 426, which may be the same as or similar to the electrical conductors 16, 126, 226, and/or 326, for example. Each IMLA 408 may further include one or more fusible elements, such as solder balls, which may be the same as or similar to the solder balls 17, 128, 228, and/or 328, for example.

Each housing 406 may include one or more inwardly-facing recesses (not shown) formed therein for receiving one or more projections (e.g., the projections 144) of the outermost IMLAs 408. Interference between the projections and the peripheral surfaces of the inwardly-facing recesses may help retain the IMLAs 408 in the housing 406.

Figure 49:
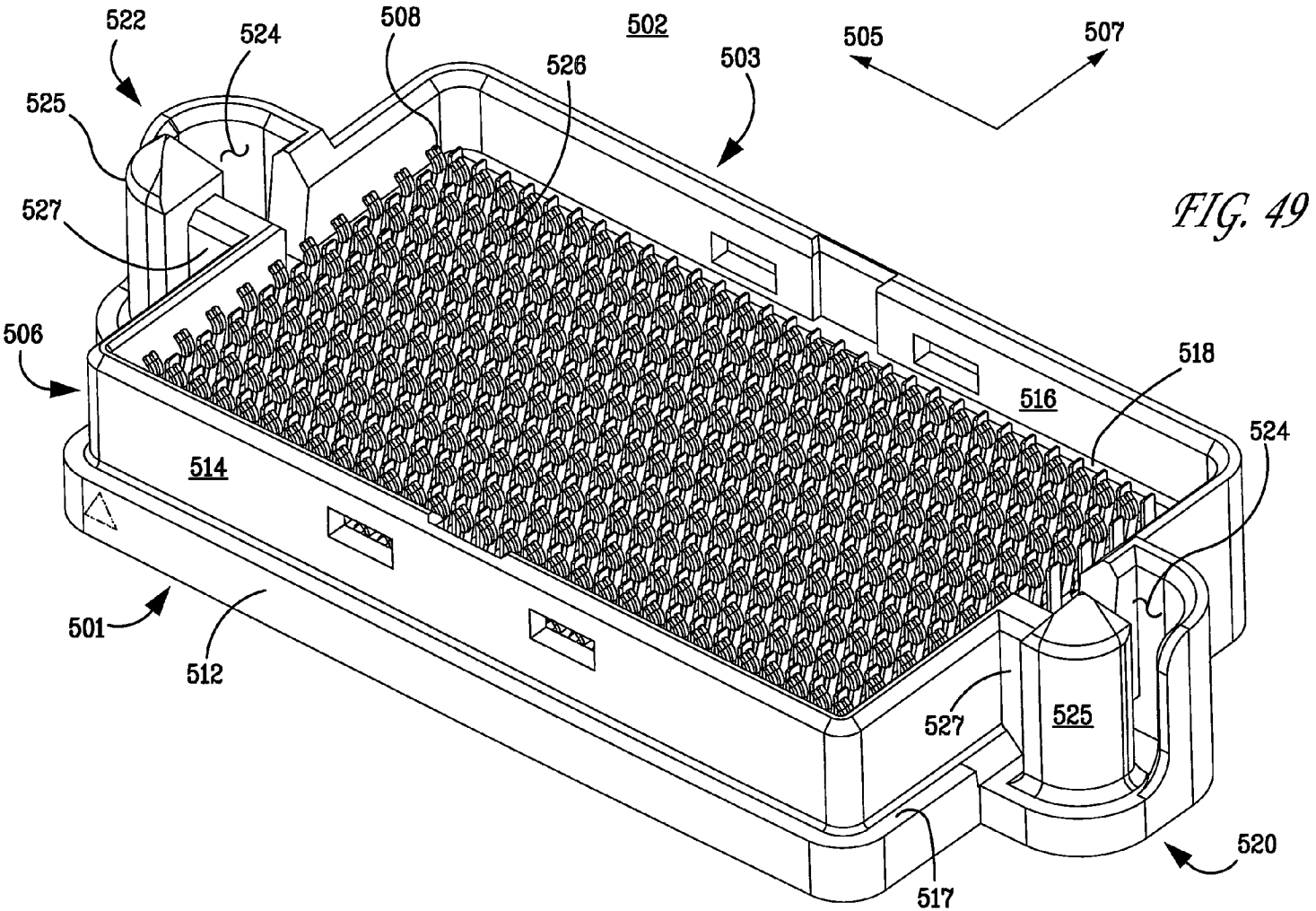
FIG. 49 is a perspective view of yet another alternative embodiment of the connector portion shown in FIG. 47.

FIG. 49 depicts a connector portion 502 according to yet another alternative embodiment. The connector portion 502 may be substantially similar to the first connector portion 302 described above, i.e., the connector portion 502 generally may include all of the same elements as the connector portion 302. Thus, like the first connector portion 302, the connector portion 502 may be configured to mate with another connector portion (not shown) that is substantially identical to the connector portion 502. As such, the foregoing description of the first and second connector portions 302, 304 may apply equally to the connector portion 502, unless otherwise noted.

The connector portion 502 may include a housing 506 with a first end 520 and a second end 522 that is opposite the first end 520 in a direction 505. The housing 506 may also include a first side 501 and a second side 503 that is opposite the first side 501 in a direction 507. The direction 505 and the direction 507 may be substantially perpendicular to one another.

The first side 501 and the second side 503 of the housing 506 may each define a sidewall 512. As can be seen from a comparison of the first connector portion 302 in FIG. 46 and the connector portion 502 in FIG. 49, the connector portion 502 may have a thinner profile relative to the first connector portion 302. That is, the sidewalls 512 of the connector portion 502 may be smaller than the sidewalls 312 of the first connector portion 302.

The sidewall 512 of the first side 501 may include a first sidewall portion 514. The sidewall 512 of the second side 503 may include a second sidewall portion 516. Together, the first sidewall portion 514 and the second sidewall portion 516 may form the upper portion of the sidewall 512 of the housing 506. The first sidewall portion 514 may be thinned so that the first sidewall portion 514 is recessed in relation to the outwardly-facing surface of the first side 501 of the sidewall 512, thereby defining an outwardly-facing recess 517. The second sidewall portion 516 may be thinned so that the second sidewall portion 516 is recessed in relation to the inwardly-facing surfaces of the second side 503 of the sidewall 512, thereby defining an inwardly-facing recess 518.

The first end 520 and the second end 522 of the housing 506 may each have a bore 524 formed therein. Additionally, the first end 520 and the second end 522 may each include a pin 525 adjacent to the respective bore 524. In other embodiments, the bore 524 and the pin 525 may be part of a guide assembly that is attached to the first and second ends 520, 522 of the housing 506.

As shown in FIG. 49, the bore 524 of the first end 520 may be adjacent to the pin 525 of the first end 520 in the direction 507. Similarly, the bore 524 of the second end 522 may be adjacent to the pin 525 of the second end 522 in the direction 507. Thus, like the first and second connector portions 302, 304 shown in FIG. 46, the connector portion 502 may be mated with another connector portion that is substantially identical to the connector portion 502.

As further shown in FIG. 49, the housing 506 of the connector portion 502 may further include one or more support beams 527, which may be connected to each of the pins 525 at the first and second ends 520, 522. The housing 506 may also define a slot adjacent to each the bores 324 for receiving the respective support beams 527. The support beams 527 may provide mechanical rigidity and/or support to the pins 525 as the pins 525 are being inserted into the respective bores 524, thereby preventing the pins 525 from fracturing or breaking as the connector portion 502 is mated with another connector portion. It will be appreciated that the support beams 527 may be formed as part of the housing 506, or may be separately attached to the housing 506 and the pins 325 using any suitable mechanical means, such as a mechanical fastener and/or adhesive.

The connector portion 502 may include one or more IMLAs 508, which may be the same as or similar to IMLAs 14, 108, 208, 308, and/or 408, for example. Each IMLA 508 may include one or more electrical conductors 526, which may be the same as or similar to the electrical conductors 16, 126, 226, 326, and/or 426, for example. Each IMLA 508 may further include one or more fusible elements, such as solder balls, which may be the same as or similar to the solder balls 17, 128, 228, 328, and/or 428, for example.

Each housing 506 may include one or more inwardly-facing recesses (not shown) formed therein for receiving one or more projections (e.g., the projections 144) of the outermost IMLAs 508. Interference between the projections and the peripheral surfaces of the inwardly-facing recesses may help retain the IMLAs 508 in the housing 506.

As shown in FIGS. 47 and 49, the housing 306, 406, 506 may be populated with the same type of electrical conductors 326, 426, 526, or with different types of electrical conductors 326, 426, 526. For example, as shown in FIG. 47, the electrical conductors 326 may be arranged along spaced apart centerlines that extend along the direction 307. The electrical conductors 326 along at least one centerline may be all uniform in size and shape, such as blades or receptacle contacts. In FIG. 49, the electrical conductors 526 may be arranged along spaced apart centerlines that extend along the direction 507. A first one of the electrical conductors 526 arranged along one of the centerlines may have a first mating end and a last one of the electrical conductors 526 positioned along the same centerline may have a second mating end, which may be physically different in shape or appearance than the first mating end. For example, the first mating end may define a blade and the second mating end may define a cantilevered beam or other type of receptacle contact. The electrical conductors 526 may also alternate in a blade, cantilevered beam arrangement. When the housings 306 (shown in FIG. 46) are populated with the electrical conductors 526 (shown in FIG. 49), the respective blade conductors of one of the housings 306 (i.e., the first connector portion 302) mate with the respective cantilevered beams of the other housing 306 (i.e., the second connector portion 304), even though both of the housings 306 include identical or substantially identical electrical conductor patterns.

What is claimed:

1. The electrical connector comprising:

a first connector portion that mounts on a first surface, wherein the first connector portion includes a first housing having a first bore and a first pin adjacent to the first bore; and a second connector portion that mates with the first connector portion and mounts on a second surface, wherein the second connector portion includes a second housing having a second bore and a second pin adjacent to the second bore, and wherein the first pin is received in the second bore and the second pin is received in the first bore when the first and second connector portions are mated to one another, wherein the first pin defines an outer-surface and the second housing includes an inner-surface that defines the second bore, and wherein friction between the outer-surface of the first pin and the inner-surface of the second housing creates a retention force that inhibits the first and second connector portions from separating from one another when the first pin is at least partially received in the second bore.

2. The electrical connector of claim 1, wherein the first pin and the second bore are adapted to guide the first and second housings during mating of the first and second connector portions.

3. The electrical connector of claim 1, wherein the first connector portion is identical to the second connector portion.

4. The electrical connector of claim 1, wherein the first connector portion is non-gender specific with respect to the second connector portion.

5. The electrical connector of claim 1, wherein the first and second pins and the first and second bores define an arrangement that facilitates a proper orientation of the first and second connector portions during mating.

6. The electrical connector of claim 1, wherein the first housing defines, at a first end, the first bore and the first pin.

7. The electrical connector of claim 1, wherein an outer surface of the second pin defines a portion of the second bore.

8. The electrical connector of claim 7, wherein the first housing further has a third bore and a third pin adjacent to the third bore, wherein an outer surface of the third pin defines a portion of the third bore, wherein the second housing further has a fourth bore and a fourth pin adjacent to the fourth bore, wherein an outer surface of the fourth pin defines a portion of the fourth bore, and wherein the third pin is received in the fourth bore and the fourth pin is received in the third bore when the first and second connector portions are mated to one another.

9. The electrical connector of claim 8, wherein the first and second connector portions are constructed substantially identically.

10. The electrical connector of claim 1, wherein the first housing defines a first pair of sidewalls between the first bore and the first pin, and wherein the second housing defines a second pair of sidewalls between the second bore and the second pin.

11. The electrical connector of claim 10, wherein the first pair of sidewalls define a first outwardly-facing recess and a first inwardly-facing recess, wherein the second pair of sidewalls defines a second outwardly-facing recess and a second inwardly-facing recess, and wherein the first outwardly-facing recess is received in the second inwardly-facing recess and the second outwardly-facing recess is received in the first inwardly-facing recess when the first and second connector portions are mated to each other.

12. The electrical connector of claim 10, wherein the first and second housings define first and second cavities between the first bore and the first pin, and the second bore and the second pin, respectively, the first and second cavities carrying respective first and second pluralities of electrical conductors.

* * * * *